US005565899A

United States Patent [19]

Sugimoto et al.

[11] Patent Number: 5,565,899

[45] Date of Patent: Oct. 15, 1996

[54] INK JET APPARATUS HAVING AN INK PASSAGE DIVIDED INTO REGIONS BY A FILTER

[75] Inventors: Hitoshi Sugimoto; Kentaro Yano, both of Yokohama; Naoji Otsuka, Kawasaki; Miyuki Matsubara, Tokyo; Hiroshi Tajika; Noribumi Koitabashi, both of Yokohama; Atsushi Arai, Kawasaki; Hiromitsu Hirabayashi, Yokohama, all of Japan

[73] Assignee: Canon Kabushiki Kaisha, Tokyo, Japan

[21] Appl. No.: 193,674

[22] Filed: Feb. 7, 1994

Related U.S. Application Data

[62] Division of Ser. No. 661,209, Feb. 27, 1991, abandoned.

[30] Foreign Application Priority Data

| | | | |
|---|---|---|---|
| Feb. 28, 1990 | [JP] | Japan | 2-048176 |
| Apr. 11, 1990 | [JP] | Japan | 2-095409 |
| Apr. 11, 1990 | [JP] | Japan | 2-096832 |

[51] Int. Cl.[6] ..... B41J 2/165; B41J 2/175

[52] U.S. Cl. ..... 347/30; 347/93

[58] Field of Search ..... 347/30, 93, 92

[56] References Cited

U.S. PATENT DOCUMENTS

| | | | |
|---|---|---|---|
| 4,126,868 | 11/1978 | Kirner | 346/140 R |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,689,641 | 8/1987 | Scardovi et al. | 347/93 |
| 4,723,129 | 2/1988 | Endo et al. | 346/1.1 |
| 4,740,796 | 4/1988 | Endo et al. | 346/1.1 |
| 4,926,196 | 5/1990 | Mizoguchi et al. | 346/140 R |
| 4,931,811 | 6/1990 | Cowger et al. | 347/93 |
| 4,952,947 | 8/1990 | Kyoshima | 346/140 R |
| 4,977,459 | 12/1990 | Ebinuma et al. | 358/296 |
| 5,055,856 | 10/1991 | Tomii et al. | 346/1.1 |

FOREIGN PATENT DOCUMENTS

| | | | |
|---|---|---|---|
| 0150958 | 8/1985 | European Pat. Off. . | |
| 061764 | 3/1988 | European Pat. Off. . | |
| 0318329 | 5/1989 | European Pat. Off. . | |
| 0273362 | 7/1989 | European Pat. Off. . | |
| 0375407 | 6/1990 | European Pat. Off. . | |
| 54-056847 | 5/1979 | Japan . | |
| 55-111267 | 8/1980 | Japan | 347/92 |
| 59-123670 | 12/1982 | Japan . | |
| 59-138461 | 8/1984 | Japan . | |
| 60-071260 | 4/1985 | Japan . | |
| 60-198255 | 10/1985 | Japan | 347/93 |
| 61-242845 | 10/1986 | Japan | 347/93 |
| 2198864 | 8/1990 | Japan . | |

*Primary Examiner*—Benjamin R. Fuller
*Assistant Examiner*—David Yockey
*Attorney, Agent, or Firm*—Fitzpatrick, Cella, Harper & Scinto

[57] ABSTRACT

An ink jet recording apparatus includes ink ejecting outlets for ejecting ink, an ink container for containing the ink to be supplied to the ejecting outlets, ink supply passage for supplying the ink from the container to the ejecting outlets, a recovery system for forcedly ejecting the ink through the ejecting outlets. The recovery system repeats the forced ejecting action, and a quantity of the ink ejected by one forced ejecting action is larger than an inside volume of the ink supply passage.

7 Claims, 25 Drawing Sheets

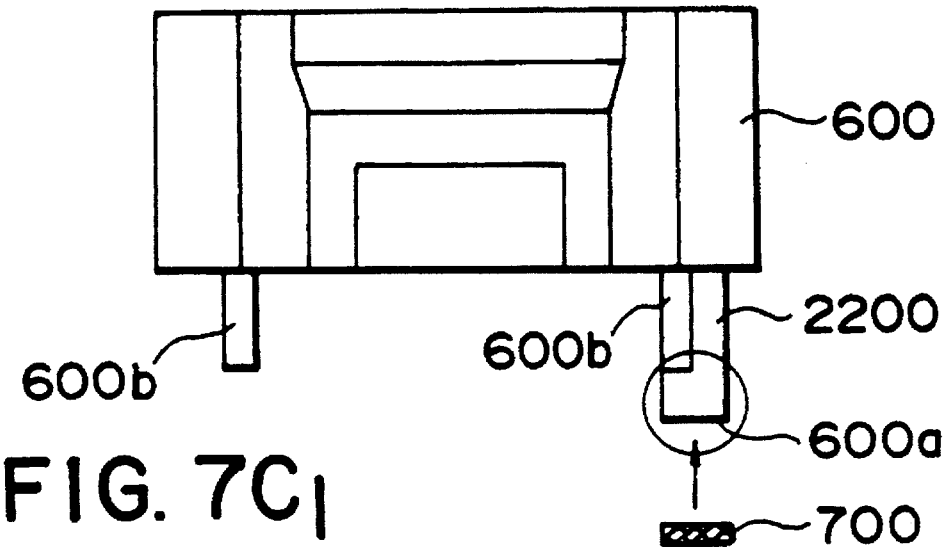
FIG. 7C1
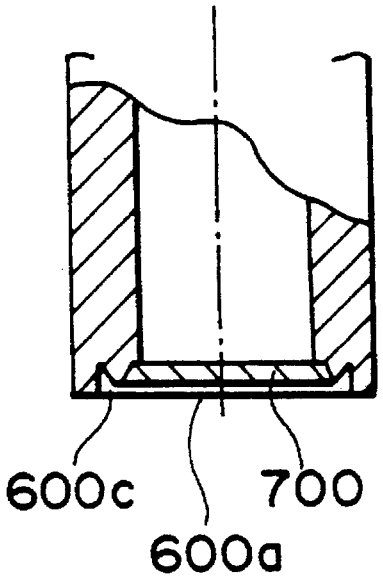
FIG. 7C2

INK JET APPARATUS HAVING AN INK PASSAGE DIVIDED INTO REGIONS BY A FILTER

FIELD OF THE INVENTION AND RELATED ART

This application is a division, of application Ser. No. 07/661,209 filed Feb. 27, 1991, now abandoned.

The present invention relates to an ink jet recording head cartridge having a recording head provided with an ink ejector (discharger) for ejecting (discharging) ink and an ink container as a unit and to an ink jet recording apparatus having the cartridge.

Conventional ink jet recording apparatuses are generally categorized in one of the following types:

(1) It comprises a separate non-replaceable type recording head and an ink container, wherein they are connected by an ink supply tube.

(2) It comprises a separate non-replaceable recording head and a replaceable ink container, wherein they are connected by an ink supply tube.

(3) It comprises a replaceable recording head having as a unit a recording head and an ink container, whereby the recording head is detachably mountable to a recording apparatus.

Of these types, the first and second type are such that the recording head is fixed on the apparatus. Therefore, when an error occurs in the head, maintenance servicing is required with the result of larger out-of-use period.

In the first and second types, the ink is supplied from the ink container through an ink supply tube. The following problems arise:

(1) The service life and reliability of the recording head are desirably made longer with the result of increased manufacturing cost.

(2) The ink supply tube is required with the result of cost increase. In a serial-scan type apparatus, a carriage for the head is reciprocated. The ink tube has to follow the carriage and thus a larger space is required.

(3) Air can be relatively easily introduced into the ink supply tube. If this occurs, the flow of the ink is disturbed. The introduction of the air may result in ejection failure of the recording head. When the air or the like is introduced into the ink supply tube or where the supply pipe lacks the ink, it is usual that the ink must be discharged through the ejection outlet in a recovery operation. For this recovery operation, a large capacity pump is required, with the result of difficulty of reduction of the size of the apparatus. In addition, a large quantity of ink is discharged by the recording operation with the result of higher running cost.

In the second type, there is a possibility of air introduction into the supply tube, particularly when the ink container cartridge is replaced. Therefore, the above problem (3) is remarkable.

Then, the third type recording head is advantageous from the standpoint of avoiding the above problems. The third type, therefore, is desirable because of the small size, low cost and reduction of non-usable period.

Referring to FIG. 1, there is shown in a cross-section, an example of ink jet recording head in the form of a cartridge with an integral ink container.

FIG. 2 is a cross-section of a major part of another example of an ink jet recording head in the form of a cartridge. The head comprises a head chip 400*a* constituting an ink ejector and an ink container. The head chip 400*a* has ink passages communicating with ink ejection (discharging) outlets 111. In the passages, there are provided energy generating elements for generating energy contributable to ejecting the ink (for example, electrothermal transducers for causing film boiling). A common ink chamber 401*a* communicates with the ink passages and is supplied with the ink from an ink container 1000 through an ink supply passage 1600*a*. An air vent 100*a* is provided in the ink container.

In the connection between the head chip 400*a* and the ink container 1000, a mesh filter 700 is provided to prevent introduction of foreign matter or air bubbles possibly existing in the ink container 1000 into the head chip 401*a*. The filter 700 is mounted when the separate ink container 1000 and head chip 400*a* are joined together, because of easy manufacturing.

The ink container 1000 contains an ink absorbing material made of porous, fibrous or continuous porous material, which absorbs and retains the ink. The absorber 900 is compressed to a proper extent so that the retaining capacity is increased. It is effective to assure a predetermined negative pressure at the ink ejection outlets to permit the meniscus in the ink ejection outlet to be retracted to a proper extent. By this, the ink is prevented from leaking out through the ejection outlets. In the case where the ejection outlets are oriented downwardly in use, it is effective to prevent the ink leakage.

However, the recording head having the structure still has the problems which will be described in the following paragraphs.

When the meniscus at the ejection outlet is broken by disturbance of the balance with the vacuum in the ink container 1000, it is possible that the ink is absent in the area from the ejection outlet 111 toward the common ink chamber 401*a*. Then, the ink supply from the ink container 1000 is stopped, and the ink in the ink passage 1600*a* is retracted in the detection indicated by an arrow a by vacuum of the absorber 900 in the ink container 1000 to such an extent that the ink is completely absorbed by the absorbing material 900 through the filter 700.

If the recording head alone or the recording head mounted in the recording apparatus is left unused for a long period of time, a bubble or bubbles may be produced in the ink due to evaporation of the solvent of the ink and the dissolved gasses. If it is further left unused, the evaporation proceeds even to such an extent that the bubbles are developed to evacuate the ink in the ink supply passage 1600*a*. If the bubbles are stagnated in the ink passage 401, the supply of the ink is disturbed with the result of improper ink ejection. In order to avoid this by permitting the ink supply, even upon the production of more or less bubbles, the cross-sectional area of the ink supply passage 1600*a* is made large. By doing so, the inside volume of the ink passage of the ink jet recording head becomes large. Then, a large capacity sucking pump is required to permit sucking recovery when the inside of ink ejector 400*a* lacks the ink by the long term non-use or by the ink dropping out.

If the capacity of the pump is small, it would be possible to suck the ink in the middle of the ink passage of the recording head. This, however, is not enough, because the ink is retracted by the vacuum of the absorbing material 900, so that the recording head is not filled with the ink even if the sucking operation is repeated.

Recently, a very small size portable ink jet recording apparatus has been commercialized. Particularly in such a small recording apparatus, it is difficult from the standpoint of the required space to use such a large capacity pump. In addition, even if it is possible, the manufacturing cost and the running cost are increased because of the large consumption of ink.

SUMMARY OF THE INVENTION

Accordingly, it is a principal object of the present invention to provide an ink jet recording apparatus wherein the ink passage can be filled with ink even if a small size sucking pump, for example, is used.

It is another object of the present invention to provide an ink jet recording apparatus of a small size.

It is a further object of the present invention to provide an ink jet recording apparatus of low cost.

It is a further object of the present invention to provide an ink jet recording apparatus of low running cost.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 7C (comprising FIGS. $7C_1$ and $7C_2$) is a partly broken front view of an ink supply system of the ink jet unit according to an embodiment of the present invention.

DESCRIPTION OF THE PREFERRED EMBODIMENTS

FIGS. 3A, 3B, 4, 5 and 6 illustrate an ink jet unit IJU, an ink jet heat IJH, an ink container IT, an ink jet cartridge IJC, a head carriage HC and a main assembly IJRA of an ink jet recording apparatus, according to an embodiment of the present invention, and relations among them. The structures of the respective elements will be described in the following.

Figure 3A:
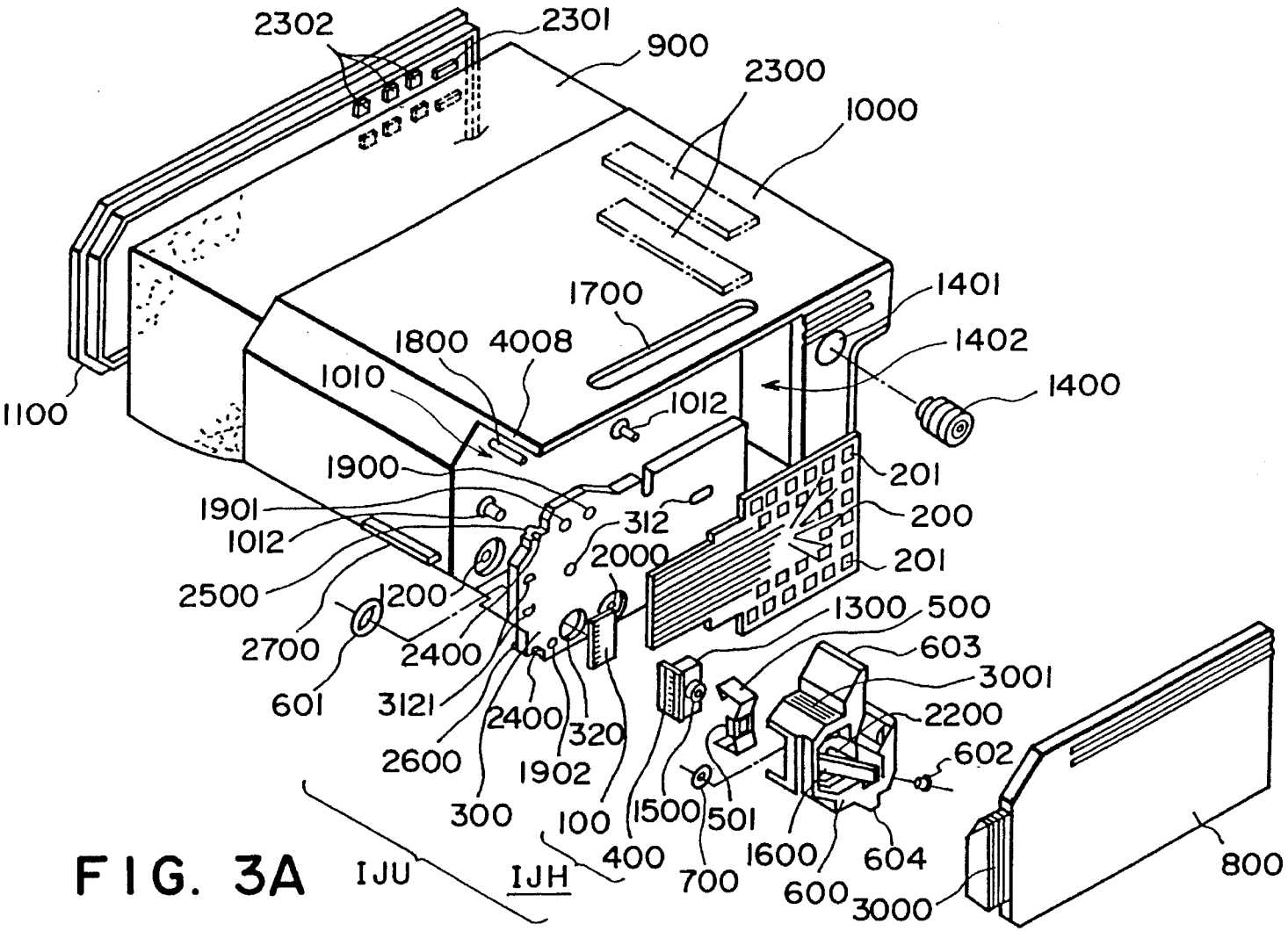
FIG. 3A is an exploded perspective view of an example of an ink jet cartridge according to an embodiment of the present invention.

As will be understood from the perspective view of FIG. 3A, the ink jet cartridge IJC in this embodiment has a relatively large ink accommodation space, and an end portion of the ink jet unit IJU is slightly projected from the front side surface of the ink container IT. The ink jet cartridge IJC is mountable at a correct position on the carriage HC (FIG. 5) of the ink jet recording apparatus main assembly IJRA by proper positioning means and with electric contacts, which will be described in detail hereinafter. It is, in this embodiment, a disposable type head detachably mountable on the carriage AC. The structures disclosed in FIGS. 3A–6 contain various novel features, which will first be described generally.

(i) Ink Jet Unit IJU

The ink jet unit IJU is of an ink jet recording type using electrothermal transducers which generate thermal energy, in response to electric signals, to produce film boiling of the ink.

Referring to FIG. 3A, the unit comprises a heater board 100 having electrothermal transducers (ejection heaters) arranged in a line on an Si substrate and electric lead lines made of aluminum or the like to supply electric power thereto. The electrothermal transducer and the electric leads are formed by a film forming process. A wiring board 200 is associated with the heater board 100 and includes wiring corresponding to the wiring of the heater board 100 (connected by the wire bonding technique, for example) and pads 201 disposed at an end of the wiring to receive electric signals from the main assembly of the recording apparatus.

A top plate 1300 is provided with grooves which define partition walls for separating adjacent ink passages and a common liquid chamber for accommodating the ink to be supplied to the respective ink passages. The top plate 1300 is formed integrally with an ink jet opening 1500 for receiving the ink supplied from the ink container IT and directing the ink to the common chamber, and also with an orifice plate 400 having the plurality of ejection outlets corresponding to the ink passages. The material of the integral mold is preferably polysulfone, but may be another molding resin material.

A supporting member 300 is made of metal, for example, and functions to support a backside of the wiring board 200 in a plane, and constitutes a bottom plate of the ink jet unit IJU. A confining spring 500 is in the form of "M" having a central portion urging against the common chamber with a light pressure, and a clamp 501 urges concentratedly with a line pressure to a part of the liquid passage, preferably the part in the neighborhood of the ejection outlets. The confining spring 500 has legs for clamping the heater board 100 and the top plate 1300 by penetrating through the openings 3121 of the supporting plate 300 and engaging the back surface of the supporting plate 300. Thus, the heater board 100 and the top plate 1300 are clamped by the concentrated urging force by the legs and the clamp 501 of the spring 500. The supporting plate 300 has positioning openings 312, 1900 and 2000 engageable with two positioning projections 1012 and positioning and fuse-fixing projections 1800 and 1801 of the ink container IT. It further includes projections 2500 and 2600 at its backside for the positioning relative to the carriage HC of the main assembly IJRA.

In addition, the supporting member 300 has a hole 320 through which an ink supply pipe 2200, which will be described hereinafter, is penetrated for supplying ink from the ink container. The wiring board 200 is mounted on the supporting member 300 by a bonding agent or the like. The supporting member 300 is provided with recesses 2400 and 2400 adjacent the positioning projections 2500 and 2600.

Figure 3B:
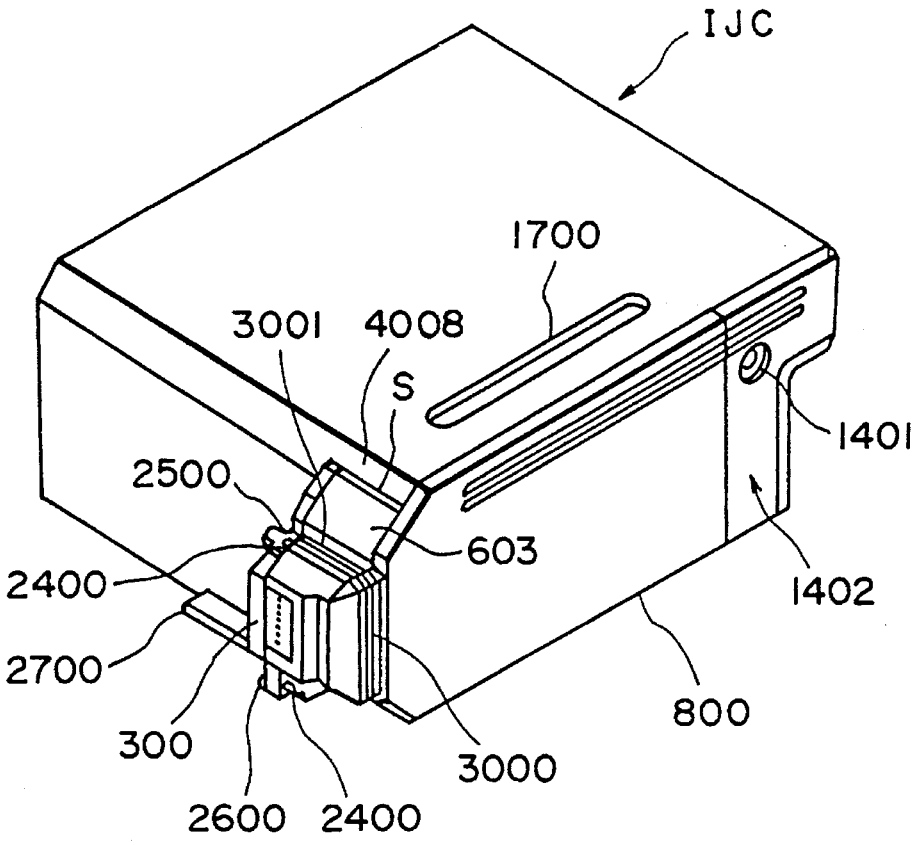
FIG. 3B is a perspective view of an ink jet cartridge according to an embodiment of the present invention.
Figure 5:
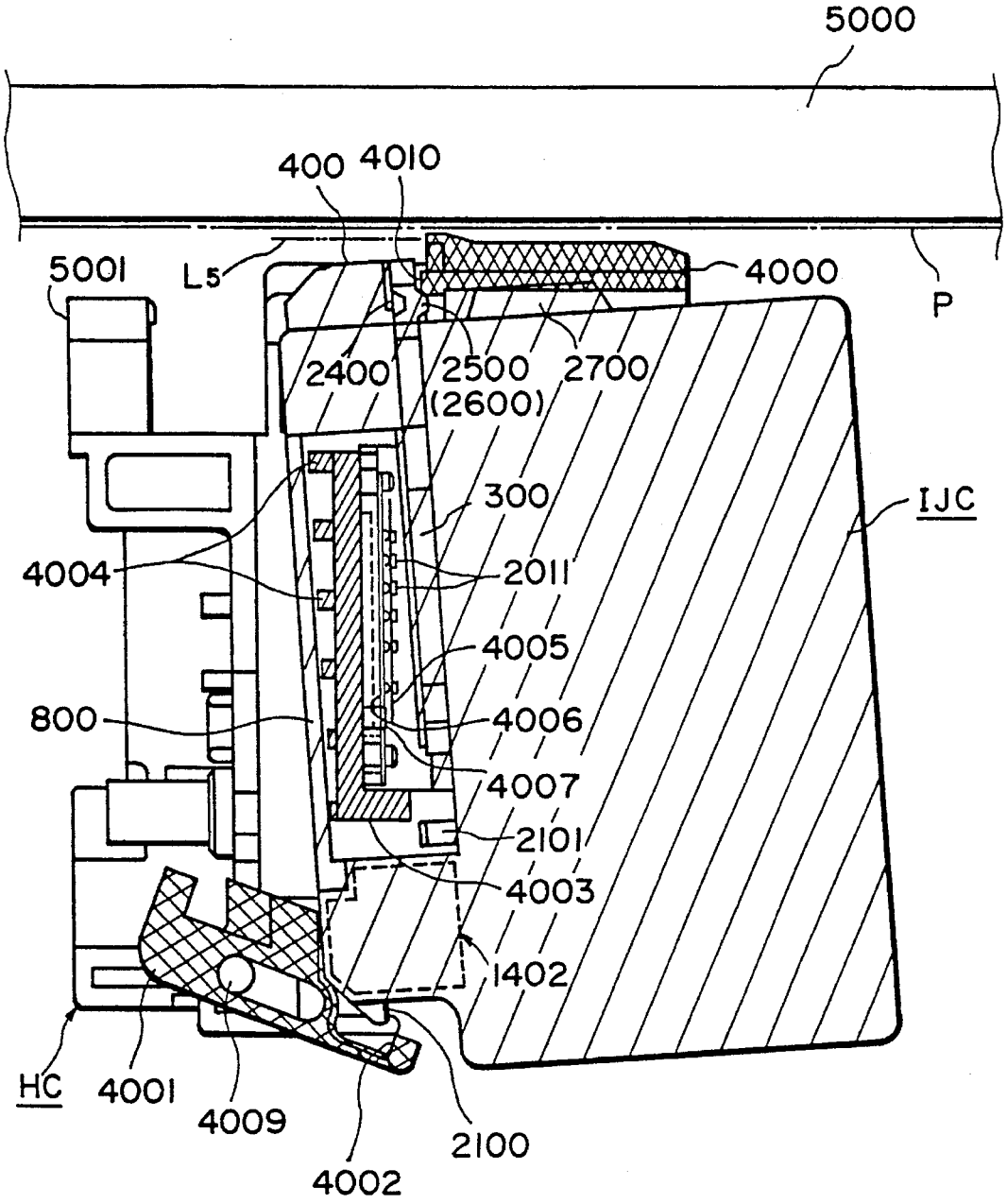
FIG. 5 is a top plan view of the ink jet cartridge which is being mounted on a carriage of the main assembly of the ink jet recording apparatus.

As shown in FIG. 3B, the assembled ink jet cartridge IJC has a head projected portion having three sides provided with plural parallel grooves 3000 and 3001. The recesses 2400 are located at extensions of the parallel grooves at the top and bottom sides to prevent ink or foreign matter moving along the groove from reaching the projections 2500 and 2600. The covering member 800 having the parallel grooves 3000, as shown in FIG. 5, constitutes an outer casing of the ink jet cartridge IJC and cooperates with the ink container to define a space for accommodating the ink jet unit IJU. The ink supply member 600 having the parallel groove 3001 has an ink conduit pipe 1600 communicating with the above-described ink supply pipe 2200 and cantilevered at the supply pipe 2200 side. In order to assure the capillary action at the fixed side of the ink conduit pipe 1600 and the ink supply pipe 2200, a sealing pin 602 is inserted.

A gasket 601 seals the connecting portion between the ink container IT and the supply pipe 2200. A filter 700 is disposed at the container side end of the supply pipe. The ink supply member 600 is molded, and therefore, it is produced at low cost with high positional accuracy. In addition, the cantilevered structure of the conduit 1600 assures the press-contact between the conduit 1600 and the ink inlet 1500 even if the ink supply member 600 is mass-produced.

In this embodiment, the complete communicating state can be assuredly obtained simply by flowing sealing bonding agent from the ink supply member side under the press-contact state. The ink supply member 600 may be fixed to the supporting member 300 by inserting and penetrating backside pins (not shown) of the ink supply member 600 through the openings 1901 and 1902 of the supporting member 300 and by heat-fusing the portion where the pins are projected through the backside of the supporting member 300. The slight projected portions thus heat-fused are accommodated in recesses (not shown) in the ink jet unit (IJU) mounting side surface of the ink container IT, and therefore, the unit IJU can be correctly positioned.

(ii) Ink Container IT

The ink container comprises a main body 1000, an ink absorbing material and a cover member 1100. The ink absorbing material 900 is inserted into the main body 1000 from the side opposite from the unit (IJU) mounting side, and thereafter, the cover member 1100 seals the main body.

The ink absorbing material 900 is thus disposed in the main body 1000. The ink supply port 1200 functions to supply the ink to the ink jet unit IJU comprising the above-described parts 100–600, and also functions as an ink injection inlet to permit initial ink supply to the absorbing material 900 before the unit IJU is mounted to the portion 1010 of the main body.

In this embodiment, the ink may be supplied through an air vent port and this supply opening. In order to obtain a good supply of ink, ribs 2300 is formed on the inside surface of the main body 1000, and ribs 2301 and 2302 are formed on the inside of the cover member 1100, which are effective to provide within the ink container an ink existing region extending continuously from the air vent port side to that corner portion of the main body which is most remote from the ink supply opening 1200. Therefore, in order to uniformly distribute the ink in good order, it is preferable that the ink is supplied through the supply opening 1200. This ink supply method is practically effective. The number of ribs 2300 in this embodiment is four, and the ribs 2300 extend parallel to a movement direction of the carriage adjacent the rear side of the main body of the ink container, by which the absorbing material 900 is prevented from closely contacting the inner surface of the rear side of the main body. The ribs 2301 and 2302 are formed on the inside surface of the cover member 1100 at a position which is substantially an extension of the ribs 2300, however, as contrasted to the large rib 2300, the size of the ribs 2301 and 2302 are small as if it is divided ribs, so that the air existing space is larger with the ribs 2301 and 2302 than with the rib 2300. The ribs 2302 and 2301 are distributed on the entire area of the cover member 1100, and the area thereof is not more than one half of the total area. Because of the provisions of the ribs, the ink in the corner region of the ink absorbing material which is most remote from the supply opening 1200 can be stably and assuredly supplied to the inlet opening by capillary action. The cartridge is provided with an air vent port for communication between the inside of the cartridge with the outside air. Inside the vent port 1400, there is a water repellent material 1400 to prevent the inside ink from leaking outside through the vent port 1400.

The ink accommodating space in the ink container IT is substantially rectangular parallelepiped, and the long side faces in the direction of carriage movement, and therefore, the above-described rib arrangements are particularly effective. When the long side extends along the movement direction of the carriage, or when the ink containing space is in the form of a cube, the ribs are preferably formed on the entire surface of the inside of the cover member 1100 to stabilize the ink supply from the ink absorbing material 900. The cube configuration is preferable from the standpoint of accommodating as much ink as possible in the limited space. However, from the standpoint of using the ink with a minimum available part of the ink container, the provisions of the ribs formed on the two surfaces constituting a corner.

In this embodiment, the inside ribs 2301 and 2302 of the ink container IT are substantially uniformly distributed in the direction of the thickness of the ink absorbing material having the rectangular parallelepiped configuration. Such a structure is significant, since the air pressure distribution in the ink container IT is made uniform when the ink in the absorbing material is consumed so that the quantity of the remaining unavailable ink is substantially zero. It is preferable that the ribs are disposed on the surface or surfaces outside a circular arc having the center at the projected position on the ink supply opening 1200 on the top surface of the rectangular ink absorbing material and having a radius which is equal to the long side of the rectangular shape, since then the ambient air pressure is quickly established for the ink absorbing material present outside the circular arc. The position of the air vent of the ink container IT is not limited to the position of this embodiment if it is good for introducing the ambient air into the position where the ribs are disposed.

In this embodiment, the backside of the ink jet cartridge IJC is flat, and therefore, the space required when mounted in the apparatus is minimized, while maintaining the maximum ink accommodating capacity. Therefore, the size of the apparatus can be reduced, and simultaneously, the frequency of the cartridge exchange is minimized. Utilizing the rear space of the space used for unifying the ink jet unit IJU, a projection for the air vent port 1401. The inside of the projection is substantially vacant, and the vacant space 1402 functions to supply the air into the ink container IT uniformly in the direction of the thickness of the absorbing material. Because of these features described above, the cartridge as a whole is of better performance than the conventional cartridge. The air supply space 1402 is much larger than that in the conventional cartridge. In addition, the air vent port 1401 is at an upper position, and therefore, if the ink departs from the absorbing material for some reason or another, the air supply space 1402 can tentatively retain the ink to permit such ink to be absorbed back into the absorbing material. Therefore, wasteful consumption of the ink can be saved.

Figure 4:
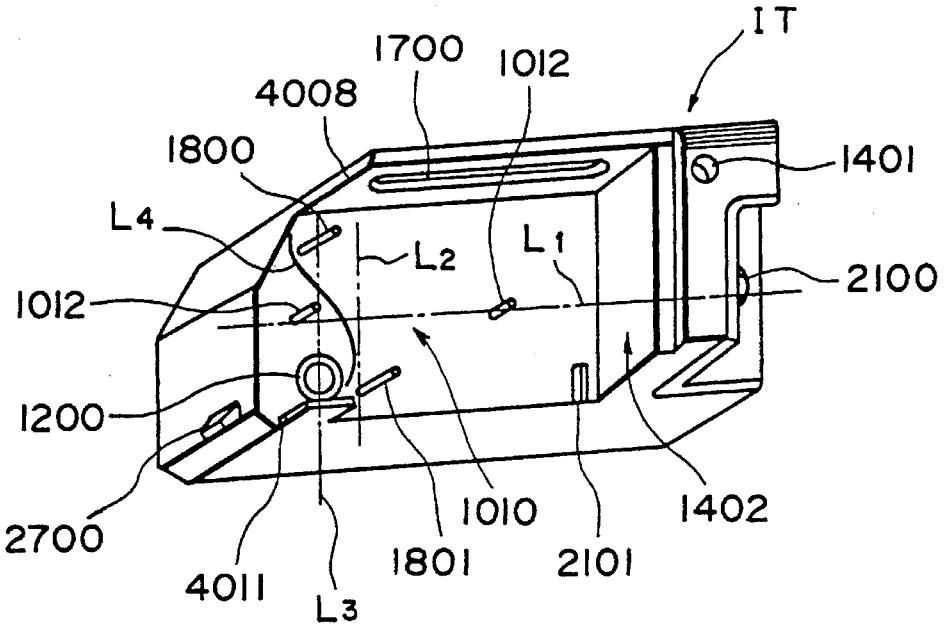
FIG. 4 is a perspective view of an ink container of an ink jet recording cartridge as seen from the ink jet recording head mounting side.

Referring to FIG. 4, there is shown a structure of a surface of the ink container IT to which the unit IJU is mounted. Two positioning projections 1012 are on a line L1 which is a line passing through the substantial center of the array of the ejection outlets in the orifice plate 400 and parallel with the bottom surface of the ink container IT or parallel to the ink container supporting reference surface of the carriage. The height of the projections 1012 is slightly smaller than the thickness of the supporting member 300, and the projections 1012 function to correctly position the supporting member 300. On an extension (right side) in this Figure, there is a pawl 2100 with which a right angle engaging surface 4002 of a carriage positioning hook 4001 is engageable. Therefore, the force for the positioning of the ink jet unit relative to the carriage acts in a plane parallel to a reference plane including the line L1. These relationships are significant, since the accuracy of the ink container positioning becomes equivalent to the positioning accuracy of the ejection outlet of the recording head, which will be described hereinafter in conjunction with FIG. 5.

Projections 1800 and 1801 corresponding to the fixing wholes 1900 and 2000 for fixing the supporting member 300 to the side of the ink container IT, are longer than the projections 1012, so that they penetrate through the supporting member 300, and the projected portions are fused to fix the supporting member 300 to the side surface. When a line L3 passing through the projection 1800 and perpendicular to the line L1, and a line L2 passing through the projection 1801 and perpendicular to the line L1, are drawn, the center of the supply opening 1200 is substantially on the line L3, the connection between the supply opening 1200 and a supply type 2200 is stabilized. Therefore, even if the cartridge falls, or even if shock is imparted to the cartridge, the force applied to the connecting portion can be minimized. In addition, since the lines L2 and L3 are not overlapped, and since the projections 1800 and 1801 are disposed adjacent to that projection 1012 which is nearer to the ink ejection outlets of the ink jet head, the positioning of the ink jet unit relative to the ink container is further improved. In this Figure, a curve L4 indicates the position of the outer wall of the ink supply member 600 when it is mounted. Since the projections 1800 and 1801 are along the curve L4, the projections are effective to provide sufficient mechanical strength and positional accuracy against the weight of the end structure of the head IJH.

An end projection 2700 of the ink container IT is engageable with a hole formed in the front plate 4000 of the carriage to prevent the ink cartridge from being displaced extremely out of position. A stopper 2101 is engageable with an unshown rod of the carriage HC, and when the cartridge IJC is correctly mounted with rotation, which will be described hereinafter, the stopper 2101 takes a position below the rod, so that even if an upward force tending to disengage the cartridge from the correct position is unnecessarily applied, the correct mounted state is maintained. The ink container IT is covered with a cover 800 after the unit IJU is mounted thereto. Then, the unit IJU is enclosed therearound except for the bottom thereof. However, the bottom opening thereof permits the cartridge IJC to be mounted on the carriage HC, and is close to the carriage HC, and therefore, the ink jet unit is substantially enclosed at the six sides. Therefore, the heat generation from the ink jet head IJH which is in the enclosed space is effective to maintain the temperature of the enclosed space.

However, if the cartridge IJC is continuously operated for a long period of time, the temperature slightly increases. Against the temperature increase, the top surface of the cartridge IJC is provided with a slit 1700 having a width smaller than the enclosed space, by which the spontaneous heat radiation is enhanced to prevent the temperature rise, while the uniform temperature distribution of the entire unit IJU is not influenced by the ambient conditions.

After the ink jet cartridge IJC is assembled, the ink is supplied from the inside of the cartridge to the chamber in the ink supply member 600 through a supply opening 1200, the hole 320 in the supporting member 300 and an inlet formed in the backside of the ink supply member 600. From the chamber of the ink supply member 600, the ink is supplied to the common chamber through the outlet, supply pipe and an ink inlet 1500 formed in the top plate 1300. The connecting portion for the ink communication is sealed by silicone rubber or butyl rubber or the like to assure the hermetical seal.

In this embodiment, the top plate 1300 is made of resin material having resistivity to the ink, such as polysulfone, polyether sulfone, polyphenylene oxide, polypropylene. It is integrally molded in a mold together with an orifice plate portion 400.

As described in the foregoing, the integral part comprises the ink supply member 600, the top plate 1300, the orifice plate 400 and parts integral therewith, and the ink container body 1000. Therefore, the accuracy in the assembling is improved, and is convenient in the mass-production. The number of parts is smaller than in conventional device, so that the good performance can be assured.

Figure 2:
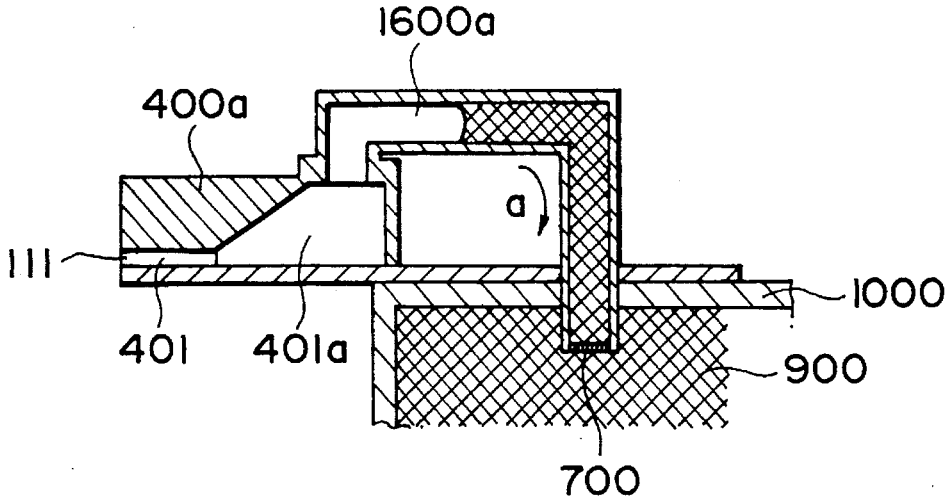
FIG. 2 is a sectional view of a recording head wherein a part of the ink is dropped out.

In this embodiment, as shown in FIGS. 2–4, the configuration after assembly is such that the top portion 603 of the ink supply member 600 cooperates with an end of the top thereof having the slits 1700, so as to form a slit S, as shown in FIG. 3B. The bottom portion 604 cooperates with fed side end 4011 of a thin plate to which the bottom cover 800 of the ink container IT is bonded, so as to form a slit (not shown) similar to the slit S. The slits between the ink container IT and the ink supply member 600 are effective to enhance the heat radiation, and also effective to prevent an expected pressure to the ink container IT from influencing directly the supply member or to the ink jet unit IJT.

The above-described various structures are individually effective to provide the respective advantages, and also they are most effective when they are combined each other.

(iii) Mounting of the Ink Jet Cartridge IJC to the Carriage HC

In FIG. 5, a platen roller 5000 guides the recording medium P from the bottom to the top. The carriage HC is movable along the platen roller 5000. The carriage HC comprises a front plate 4000, a supporting plate 4003 for electric connection and a positioning hook 4001. The front plate 400 has a thickness of 2 mm, and is disposed closer to the platen. The front plate 4000 is disposed close to the front side of the ink jet cartridge IJC, when the cartridge IJC is mounted to the carriage. The supporting plate 4003 supports a flexible sheet 4005 having pads 2011 corresponding to the pads 201 of the wiring board 200 of the ink jet cartridge IJC and a rubber pad sheet 4007 for producing an elastic force for urging the backside of the flexible sheet 4005 to the pads 2001. The positioning hook 4001 functions to fix the ink jet cartridge IJC to the recording position. The front plate 4000 is provided with two positioning projection surfaces 4010 corresponding to the positioning projections 2500 and 2600 of the supporting member 300 of the cartridge described hereinbefore. After the cartridge is mounted, the front plate receives the force in the direction perpendicular to the projection surfaces 4010. Therefore, plural reinforcing ribs (not shown) are extended in the direction of the force at the platen roller side of the front plate. The ribs project toward the platen roller slightly (approximately 0.1 mm) from the front side surface position L5 when the cartridge IJC is mounted, and therefore, they function as head protecting projections. The supporting plate 4003 is provided with plural reinforcing ribs 4004 extending in a direction perpendicular to the above-described front plate ribs. The reinforcing ribs 4004 have heights which decreases from the plate roller side to the hook 4001 side. By this, the cartridge is inclined as shown in FIG. 5, when it is mounted.

The supporting plate 4003 is provided with two additional positioning surfaces 4006 at the lower left portion, that is, at the position closer to the hook. The positioning surfaces 4006 correspond to projection surfaces 4010 by the additional positioning surfaces 4006, the cartridge receives the force in the direction opposite from the force received by the cartridge by the above-described positioning projection surfaces 4010, so that the electric contacts are stabilized. Between the upper and lower projection surfaces 4010, there is disposed a pad contact zone, so that the amount of deformation of the projections of the rubber sheet 4007 corresponding to the pad 2011 is determined. When the cartridge IJC is fixed at the recording position, the positioning surfaces are brought into contact with the surface of the supporting member 300. In this embodiment, the pads 201 of the supporting member 300 are distributed so that they are symmetrical with respect to the above-described line L1, and therefore, the amount of deformation of the respective projections of the rubber sheet 4007 are made uniform to stabilize the contact pressure of the pads 2011 and 201. In this embodiment, the pads 201 are arranged in two columns and upper and bottom two rows.

The hook 4001 is provided with an elongated hole engageable with a fixed pin 4009. Using the movable range provided by the elongated hole, the hook 4001 rotates in the counterclockwise direction, and thereafter, it moves leftwardly along the platen roller 5000, by which the ink jet cartridge IJC is positioned to the carriage HC. Such a movable mechanism of the hook 4001 may be accomplished by another structure, but it is preferable to use a lever or the like. During the rotation of the hook 4001, the cartridge IJC moves from the position shown in FIG. 5 to the position toward the platen side, and the positioning projections 2500 and 2600 come to the position where they are engageable to the positioning surfaces 4010. Then, the hook 4001 is moved leftwardly, so that the hook surface 4002 is contacted to the pawl 2100 of the cartridge IJC, and the ink cartridge IJC rotates about the contact between the positioning surface 2500 and the positioning projection 4010 in a horizontal plane, so that the pads 201 and 2011 contact to each other. When the hook 4001 is locked, that is retained at the fixing or locking position, by which the complete contacts are simultaneously established between the pads 201 and 2011, between the positioning portions 2500 and 4010, between the standing surface 4002 and the standing surface of the pawl and between the supporting member 300 and the positioning surface 4006, and therefore, the cartridge IJC is completely mounted on the carriage.

(iv) General Arrangement of the Apparatus

Figure 6:
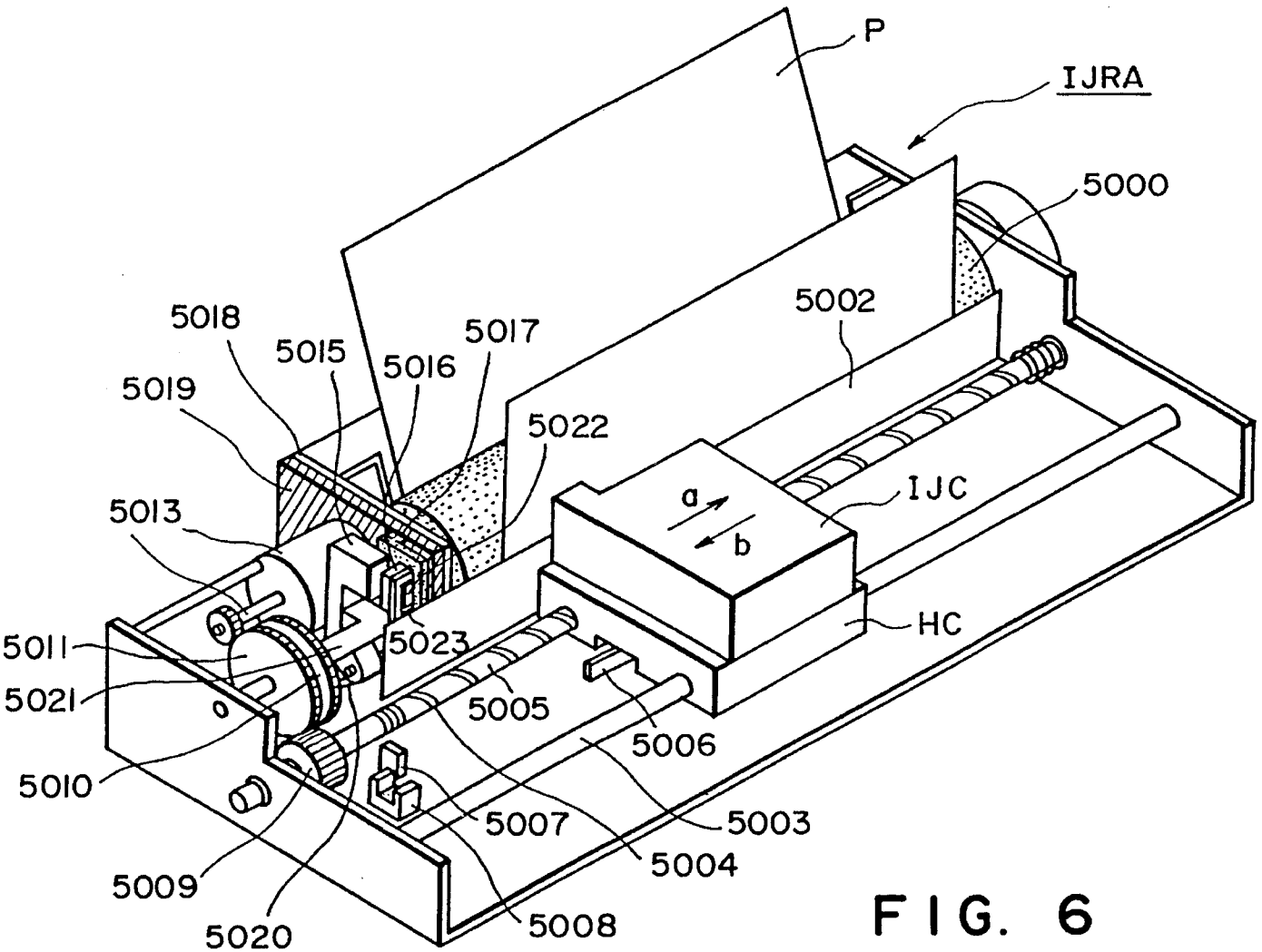
FIG. 6 is a perspective view of an ink jet recording apparatus.

FIG. 6 is a perspective view of an ink jet recording apparatus IJRA in which the present invention is used. A lead screw 5005 rotates by way of drive transmission gears 5011 and 5009 by the forward and backward rotation of a driving motor 5013. The lead screw 5005 has a helical groove 5004 with which a pin (not shown) of the carriage HC is engaged, by which the carriage HC is reciprocable in directions a and b. A sheet confining plate 5002 confines the sheet on the platen over the carriage movement range. Home position detecting means 5007 and 5008 are in the form of a photocoupler to detect presence of a lever 5006 of the carriage, in response to which the rotational direction of the motor 5013 is switched. A supporting member 5016 supports the front side surface of the recording head to a capping member 5022 for capping the recording head. Sucking means 5015 functions to suck the recording head through the opening 5023 of the cap so as to recover the recording head.

A cleaning blade 5017 is moved toward front and rear by a moving member 5019. They are supported on the supporting frame 5018 of the main assembly of the apparatus. The blade may be in another form, more particularly, a known cleaning blade. A lever 5021 is effective to start the sucking recovery operation and is moved with the movement of a cam 5020 engaging the carriage, and the driving force from the driving motor is controlled by known transmitting means such as a clutch or the like.

The capping, cleaning and sucking operations can be performed when the carriage is at the home position by the lead screw 5005 in this embodiment. However, the present invention is usable in another type of system wherein such operations are effected at different timing. The individual structures are advantageous, and in addition, the combination thereof is further preferable.

Figure 7A:
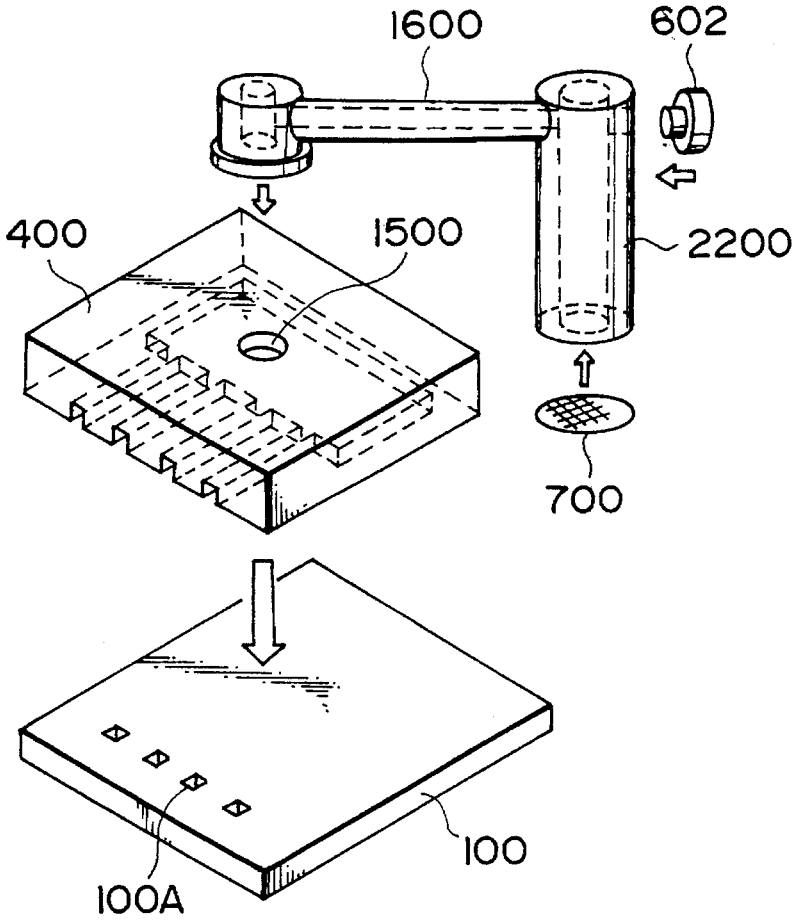
FIGS. 7A and 7B are perspective views illustrating ink supply system.
Figure 7B:
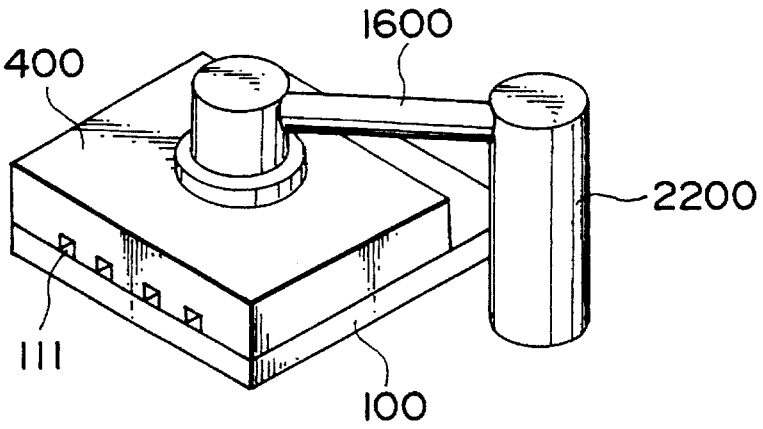

Referring to FIGS. 7A, 7B and 7C, the description will be made as to the ink supply for the recording head described in conjunction with FIGS. 3A–6. FIG. 7A is an exploded perspective view of an ink ejector of the ink jet head cartridge according to an embodiment of the present invention. In this Figure, the recording head comprises a top plate (ink passage forming member) 400 having grooves for constituting ink passages communicating with the ink ejection outlets 111, a heater board 100 having energy generating elements in the form of heaters 100A for producing energy for ejecting the ink, the heater board being effective to constitute a part of the walls for the ink passages, and an ink conduit 1600 for supplying the ink from the ink container to the ink inlet port 1500 formed in the top plate 400, the ink conduit is integral with the ink supply pipe 2200 in the form of a canti-lever. The ink passage is constituted by the ink supply tube 2200 and the ink conduit 1600. The top plate 400 and the heater board 100 are closely contacted by a leaf spring. The ink conduit 1600 and the ink supply tube 2200 are integrally formed and mounted on an ink supply member 600 (FIG. 3A) of the ink jet head.

FIG. 7B is a perspective view of the ink ejector of the ink jet head cartridge of FIG. 7A after it is assembled. An end of the ink conduit 1600 is closely contacted to the ink inlet port 1500 by the resilient force of the ink conduit 1600 having a rigidity, after the head cartridge is assembled. As an example, the pressure by the resilient force is approximately 100–200 g. In this manner, the ink conduit has a free end press-contacted to the ink passage forming member and a fixed end fixed to the ink supply member as a base end.

The ink supply member having the ink conduit 1600 and the ink supply tube 2200 is integrally molded with a resin material such as polysulfone. In this embodiment, it is not easy to constitute the complete ink passage by the molding alone, because of the structure thereof. Therefore, a sealing pin 602 not shown in FIG. 7B is press-fitted into the ink supply tube 2200 to provide the ink supply passage. When the ink supply member 600 is mounted into the ink jet cartridge, an end of the ink conduit 1600 is press-contacted to the top plate 400. In order to enhance the press-contact, a sealing agent such as TSE 399 Black, trade name, available from Toshiba Silicone Kabushiki Kaisha, may be applied to the contact portion. The sealing material may be used to simultaneously protect wire bonding pads for the electric contacts with the heater board 100.

An end of the ink supply tube 2200 having a filter 700 is urged to the formed absorbing material retaining the ink in the ink container so as to be capable of taking the ink in the ink container.

FIG. 7C is a top plan view of an example of an ink supply container provided with the ink supply tube 2200. In this example, the ink supply container 600 constituting the ink supply passage is molded similarly to the top plate 400 with a resin material exhibiting durability against the ink material. The ink conduit to which a filter 700 is heat-fused is positioned and fixed to the main body of the recording head. In this embodiment, for the positioning, a positioning pin 600*b* is formed beforehand in the ink supply container 600. The positioning point 600*b* is inserted into a through hole formed in the supporting member 300 (FIG. 3A), and it is heat-fused to the backside of the supporting member 300. In this embodiment, the supply container 600 and the filter 700, and the supply container 600 and the supporting member 300, are joined by heat-fusing. However, they may be joined by a bonding agent. However, when the supply container 600 and the filter 700 are joined by a bonding agent, it is possible that the bonding agent flows into the meshes of the filter 700 to reduce the effective area of the filter. Therefore, in this embodiment, in the heat-fusing of the filter, as shown in the partly enlarged sectional view of FIG. 7C, a filter receiving portion of the supply container 600 is recessed as indicated by a reference 600*c* to permit correct positioning of the filter 700. After the heat-fusing, the recess 600*c* protects the filter 700. Accordingly, even if it is frequently mounted into or dismounted from the ink container, the filter 700 is securedly retained in place.

As described in the foregoing, between the ink container containing the ink and the ink ejector, there are an ink supply container constituting the ink supply passage, a common ink chamber for supplying the ink to the ink passage, and a filter for removing foreign matter and bubbles. The ink jet head cartridge shown in FIGS. 3A and 3B as having the ink supply system, can be provided. This is mounted in the main assembly of the ink jet printer, as shown in FIG. 6.

Figure 8:
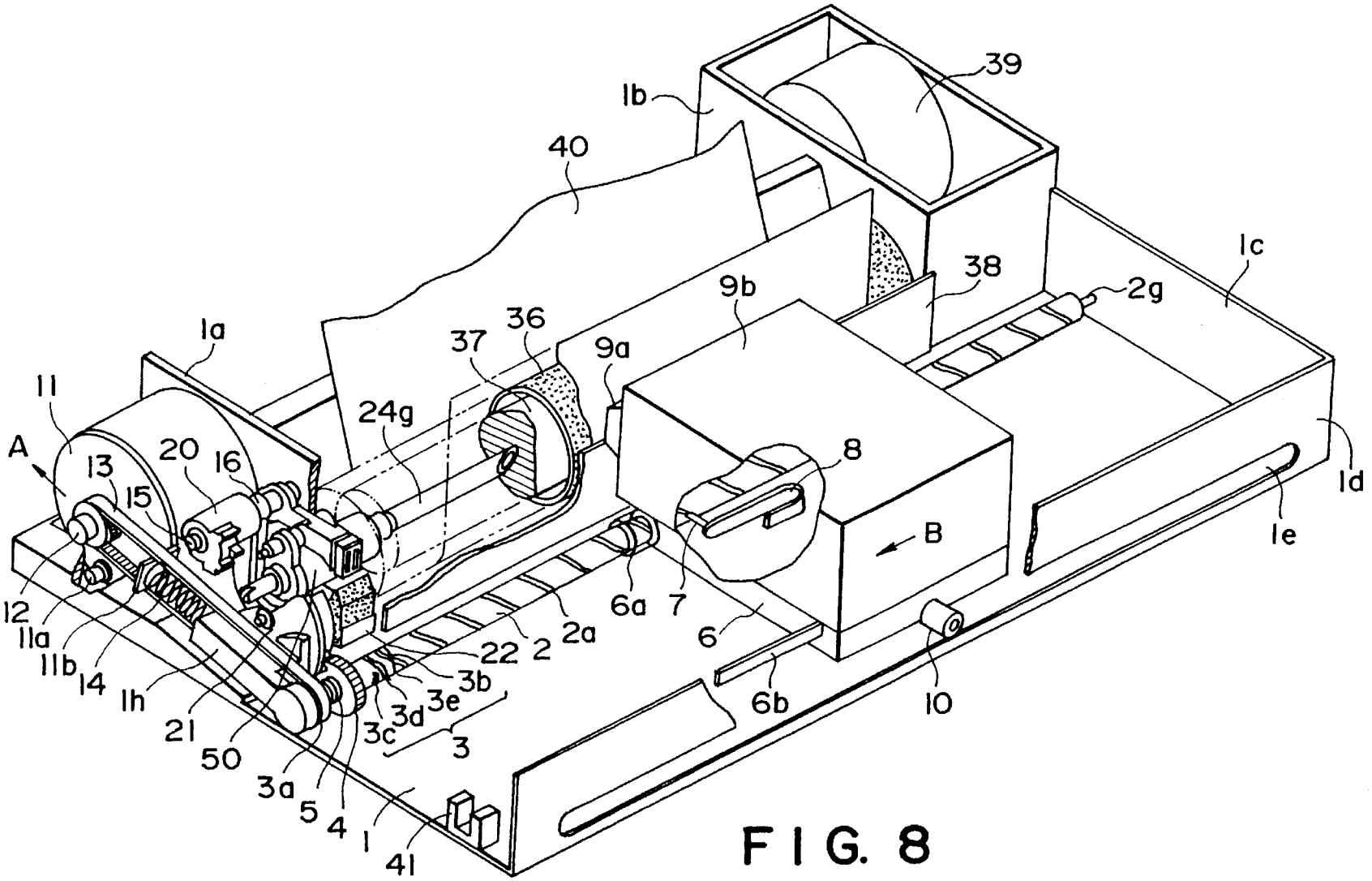
FIG. 8 is a partly broken side view of an example of an ink jet recording apparatus.

FIG. 8 is a perspective view of a liquid jet recording apparatus (ink jet recording apparatus) according to another embodiment of the present invention.

Figure 9:
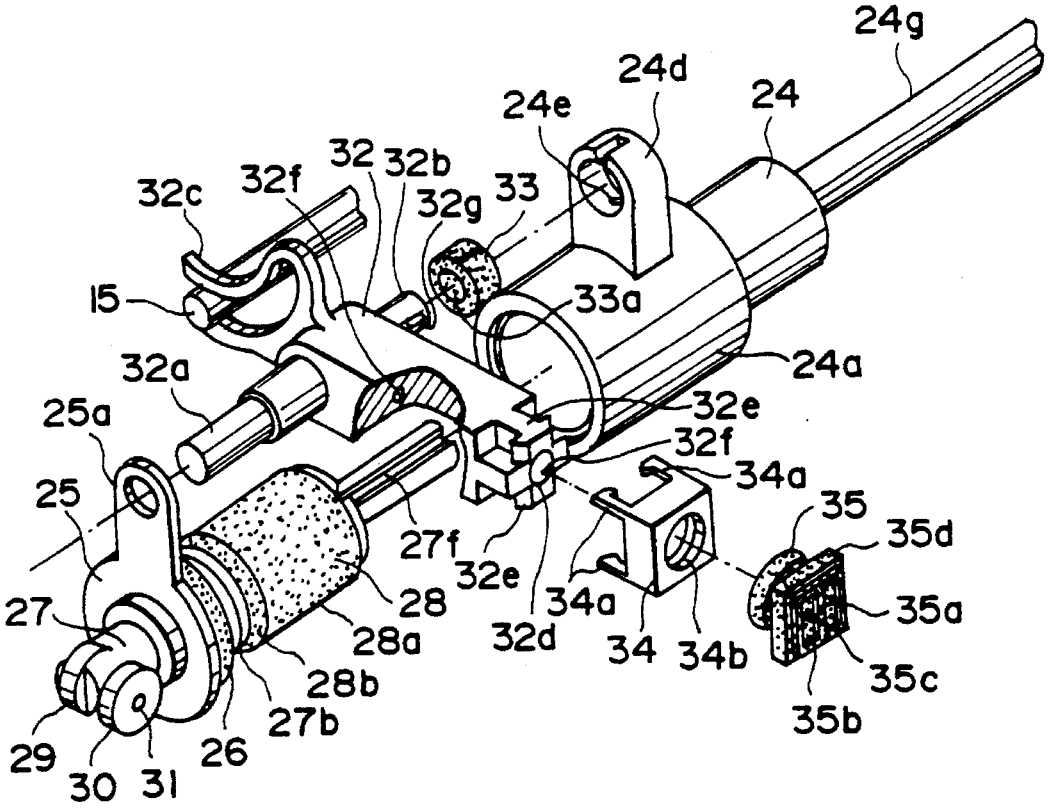
FIG. 9 is an exploded perspective view of a recovery system including a sucking pump which is a forced ink discharging means according to an embodiment of the present invention.
Figure 10:
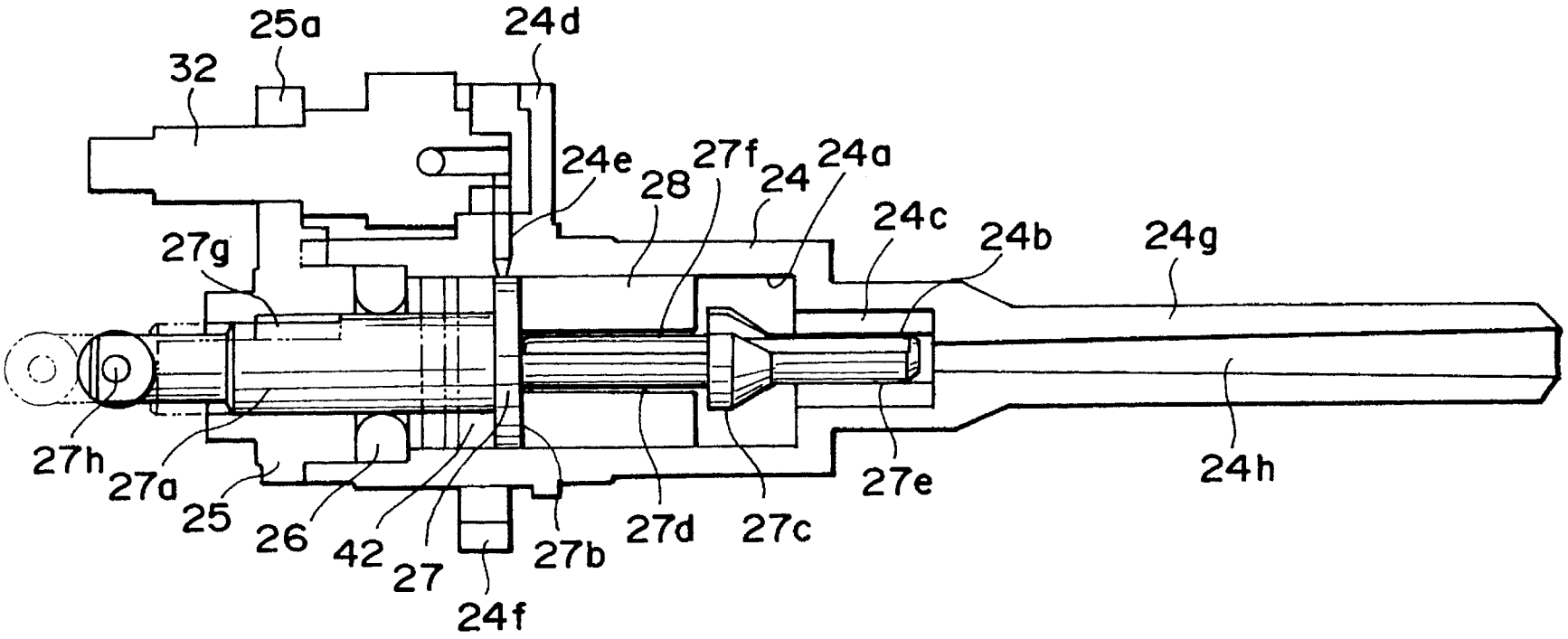
FIG. 10 is a sectional view of a recovery system including a sucking pump which is a forced ink discharging means, according to an embodiment of the present invention.

FIGS. 9 and 10 are a broken perspective view of a recovery system and a sectional view of a recovery system and a sectional view of a pump. As shown in FIG. 8, the apparatus comprises a frame 1 on which a left plate 1*a* and a right plate 1*b* (rear) are mounted, the left side plate 1*a* functioning as a guide for a recording medium such as paper. At the right end, there is mounted a front plate 1*c*, and a rear guide plate 1*d* is mounted at the front side. An elongated slot 1*e* functions to guide the carriage or carrier. The slot is engaged with a carrier guiding roller which slides therein. The frame 1 is provided with a motor mounting hole for rotatably supporting the carriage motor which will be described hereinafter, although it is not shown in the Figure.

A lead arm 1*h* supports a lead screw in the longitudinal and radial directions and is supported by bearings not shown.

The lead screw 2 has a lead screw groove 2*a* at a predetermined pitch covering a recording range. At the carriage home position side of the lead screw 2, a capping groove 3*b* for setting a home position for the capping and a pump groove 3*c* for setting a position for the recovery are formed along a vertical circumference, and the capping groove 3*b* and the pump groove 3*c* are smoothly connected by a connecting groove 3*d*. In addition, the lead groove 2*a* and the cap groove 3*b* are smoothly connected by an intermediate groove 3*e*.

To the right end of the lead screw 2, a shaft 2*g* is mounted, and another shaft is mounted to the left side. They are supported by bearings supported on a front plate 1*c* and a lead arm 1*b*, and are rotatably supported. A lead pulley 3*a* is fixedly mounted to the lead screw 2. The pulley 3*a* is driven by a motor 11 through a timing belt 13. The right shaft 2*g* of the lead screw 2 is urged in the thrust direction by an unshown leaf spring or the like.

A clutch gear 4 is supported on the lead pulley 3 for sliding movement in the longitudinal direction, and is fixed in the rotational direction so that the rotation of the lead screw 2 is transmitted thereto. A clutch spring 5 has a compression spring for urging the clutch gear toward the lead groove. A limiting member for limiting the clutch gear 4 in a predetermined movable range is formed between the clutch gear 4 and the lead pulley 3, but it is not shown in the Figure.

The carrier or carriage 6 is slidably mounted on the lead screw 2. Designated by a reference 6*a* is an urging portion for urging an end of the clutch gear 4 and is formed integrally with the left side of the carriage 6. The carriage 6 has a projection 6*b* for detecting the home position of the carriage 6. A lead pin 7 is engaged with the lead groove 2*a* of the lead screw 2 and is guided in a guiding hole (not shown) of the carriage. A lead pin spring 8 has an end mounted to the carrier 6, and the other end urges the lead pin 7.

The recording head 9 is mounted on the carriage 6. In this embodiment, the recording head is in the form of a cartridge detachably mountable on the carriage 6, and it comprises a head element 9*a* for ejecting the ink and an integral ink container 9*b* functioning as an ink supply source. After the ink is consumed, for example, the recording head is replaceable. The recording head has ejection energy generating elements in the head element 9*a* to eject the ink. The ejection energy generating element may be in the form of electrothermal transducers or electromechanical transducers. Of these elements, the former is preferable from the standpoint of high density arrangement of the ink ejection outlets and of the simple manufacturing steps.

Carriage rollers 10 are rotatably mounted to the rear side of the carriage, and are rotatably engaged with the elongated slot 1*c* of the frame 1.

A carriage motor 11 is in the form of a pulse motor, for example. Rotatable pins 11*a* mounted to the bottom portions of the front and rear side of the carriage motor are aligned and mounted. The rotatable pins 11*a* (the one at the rear side is not shown) are rotatably mounted in motor mounting holes formed in the frame 1. The carriage motor 11 is rotatable about the rotatable pins 11*a*. A spring receiving portion 11*c* is integrally formed with the carriage motor 11 and is extended in parallel with the shaft of the motor to receive a motor spring 14 which will be described hereinafter. The spring receiving portion has a columnar projection to which an end of a motor coil spring 14 is fixed.

A motor pulley 12 is fixed on the motor shaft of the carriage motor 11. A timing belt 13 is stretched between the motor pulley and the pulley 3*a* of the lead screw 2 shaft. The motor spring 14 is a compression spring in this embodiment. It is mounted between an end of the lead arm 1*h* and the spring receiving portion 11*b* of the carrier motor 11, so that the carriage motor 11 is urged in the direction A, by which the timing belt 13 is stretched.

A setting shaft 15 is mounted vertically on the left side plate 1*a*. To the setting shaft, there is mounted means for improving the ejection outlet forming surface and a mechanism for capping and for ejection recovery.

Referring mainly to FIGS. 9 and 10, a recovery unit will be described. In FIGS. 9 and 10, a cylinder 24 has a cylindrical portion 24*a* and a guiding portion 24*b* for guiding a piston shaft. A part of the guiding portion 24*b* is partly cut-away to provide an ink passage 24*c*. Designated by a reference 24*d* is a cap lever receiving portion to receive a lever seal. An ink passage 24*e* is opened at a predetermined position of the cylinder 24*a*. A rotatable lever 24*f* is formed integrally with the cylinder 24 and is rotated by a spring 22*b* of an ink absorbing material spring 22. A residual ink pipe 24*g* is integrally formed with the cylinder 24. An end thereof is sharply cut at an acute angle to permit easy insertion into the residual ink absorbing material. An ink passage 24*h* is formed in the residual ink pipe 24*g*.

A cylinder cap 25 is press-fitted to an end of the cylinder 24. A lever guide 25*a* is disposed faced to the cap lever receiving portion 24*d* of the cylinder 24.

A piston seal 26 is in the cylinder 24 and has an inside diameter slightly smaller to provide a predetermined press-contact with the piston shaft which will be described hereinafter. It is possible to apply lubricant paint on the surface to reduce the force required for the sliding of the piston shaft.

A piston shaft 27 includes an acting shaft 27*a*, a piston stopper 27*b*, a piston receptor 27*c*, a connecting shaft 27*d* and a guide shaft 27*e*. A groove 27*f* providing the ink passage is formed along the connecting shaft 27*d* and a guiding shaft 27*e*. A rotation preventing groove 27*g* is formed in the acting shaft 27*a*. In an end surface of the acting shaft 27*a*, adjacent an end of the acting shaft 27*a*, there is a bearing 27*b*.

A piston 28 has a main body of elastic porous material constituting an internal layer as seen from the cylinder sliding side. It may be a foamed material (sponge or the like) having independent pores and a porous material having continuous pores such as continuous fine porous material. Preferably, however, it is made of continuous fine porous material such as urethane foam. It may contain plural continuous pores extending in a direction crossing with the direction of the elastic deformation. The outer diameter thereof is larger than the inside diameter of the cylinder by a predetermined degree, so that when it is inserted into the cylinder 24, it is properly compressed. The outer circumferential surface 28*a* and an end surface 28*b* contacts to the piston stopper 27*b* of the piston shaft 27 is coated with a solid (skin) layer provided during the foaming of the piston. Even if the piston main body is made of the material produced by communication foaming, the skin does not pass therethrough the liquid, so that the sealing is possible. Therefore, the piston 28 accomplishes its function. In the case wherein the skin is not provided, a separate sealing coat may be used.

Designated by a reference numeral 42 is a pump chamber. A piston urging roller 29 is rotatably mounted to an end of the piston shaft 27. A piston returning roller 30 is rotatably mounted to an end of a piston shaft 27. Designated by reference numeral 31 is a shaft for such rollers.

A cap lever 32 has a rotatable shaft 32*a*, an ink guide 32*b* and a lever guide 32*c*. At an end thereof, a sealing surface 32*d* is formed in the form of a projected spherical shape. A vertical couple of engaging portions 32*e* are provided to engage with pawls of the cap holder which is described hereafter. An ink passage 32*f* is formed from the sealing surface 32*d* in the lever. The ink passage 32*f* is bent at right angles and is extended through the center of the ink guide 32*b* and is opened at an end surface thereof. The bottom side of the ink guide 32*b* is provided with a cut-away portion 32*g*.

A lever seal 33 receives an ink guide 32*b* and is press-fitted into the cap lever receptor 24*d*. A communicating bore 33*e* functions to communicate the cut-away portion 32*g* of the ink guide 32*b* with the ink passage 24*c*.

A cap holder 34 is disposed at a position where it faces a hook 34*a* engageable with an engaging portion 32*e* of the cap lever 32. An opening 34*b* is used to mount the cap, which will be described hereinafter.

A cap 35 has a sealing cap 35*a* for preventing the usual ink drying, and a sucking cap 35*b*, adjacent thereto, for sucking the ink. The sucking cap 35*b* is provided with a sucking opening 35*c*. The ink passage is bent in the cap so that the ink passage is opened through the center thereof toward the cap holder 34.

A flange 35*d* functions to retain it when mounted on the cap holder 34. The flange 35*d* has a cap sealing portion 35*e* having a concave spherical shape with the same curvature as the sealing surface 32*d* of the cap lever 32. When it is urged to the cap lever 32, only the opening communicates, while the other portions are sealed. Since the sealing portions (32*d*, 35*d*) are spherical, the cap member is equalized in good manner, so that even if the ejection side surface has a stepped portion, the stepped portion is easily accommodated, so that the stabilized sealed state is established.

Figure 12A:
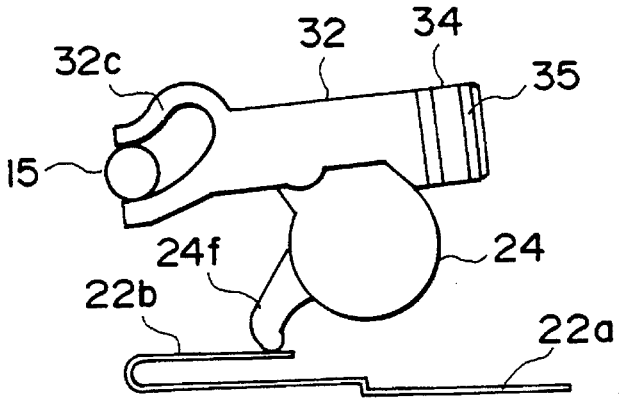
FIGS. 12A, 12B and 12C are side views illustrating the sequential operation of the sequential capping operation.
Figure 12B:
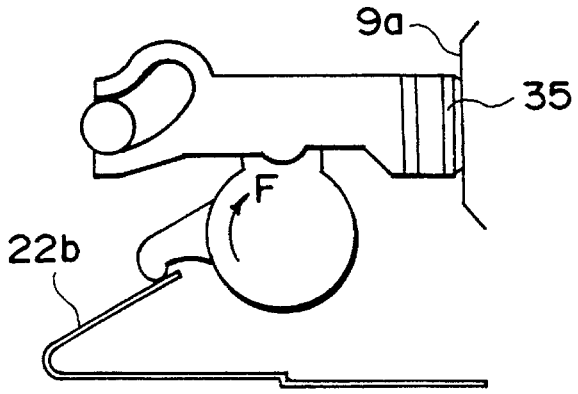
Figure 12C:
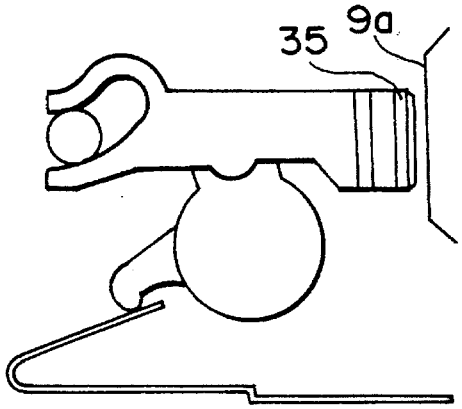

The description will be made as to a sucking recovery operation which is performed when the ejection is not sufficiently improved by the preliminary ejection operation. When the recovery operation is to be started, the timing gear 21 is further rotated from the capping position, by which the cap lever 32 is urged by the cap cam 21*b*, by which the cap 35 is slightly away from the ejection side surface, as shown in FIG. 12C.

Then, the lead bin 7 moves along the connecting groove 3*d* to the pump groove 3*c*, by which the carriage 6 moves in the direction B by a predetermined distance (the distance between the cap groove and the pump groove).

When the timing gear 21 rotates further in the direction D, the cap 35 is disengaged from the cap cam 21*d*, upon which the cap 35 is press-contacted to the ejection side surface. At this time, the recording head 9 is moved, and therefore, the ejection side surface is capped by the sucking cap 35*b*.

Figure 11A:
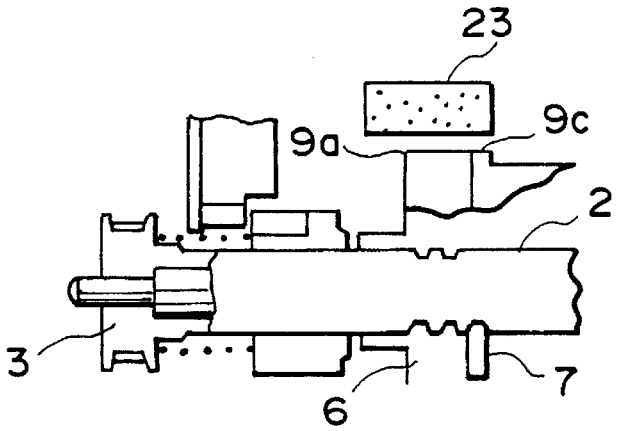
FIGS. 11A, 11B and 11C are plan views illustrating the positional relationship between the recording head and members acting thereon during a preliminary ejection period, a capping period and a sucking recovery period.
Figure 11B:
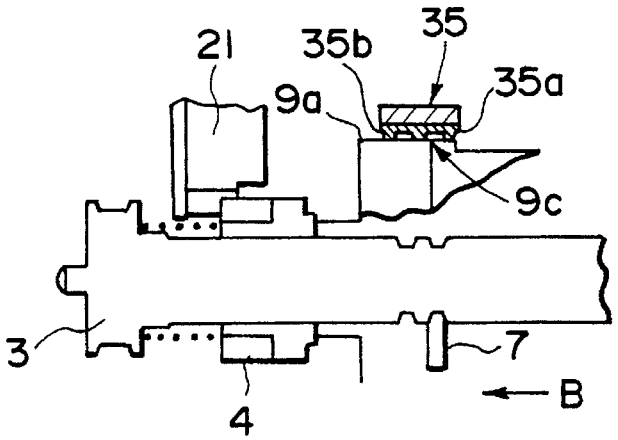

As shown in FIG. 11, the ejection outlets 9*c* are deviated from the ejection side surface toward the recording region. Upon the normal capping operation without the sucking action, the whole surface of the cap 35 faces the ejection side surface, as shown in FIG. 11B, and therefore, the pressure of the cap 35 to the ribs is smaller. However, at this time, what is required is only to seal it, and therefore, the dry-preventing effect is not disturbed. Thus, pressure of approximately 10 g is enough to seal it. In addition, the claps of the ribs are small, so that the reduction of the inside volume of the cap is small, and therefore, the ink meniscus upon the capping is not retracted, and therefore, it is advantageous.

Figure 11C:
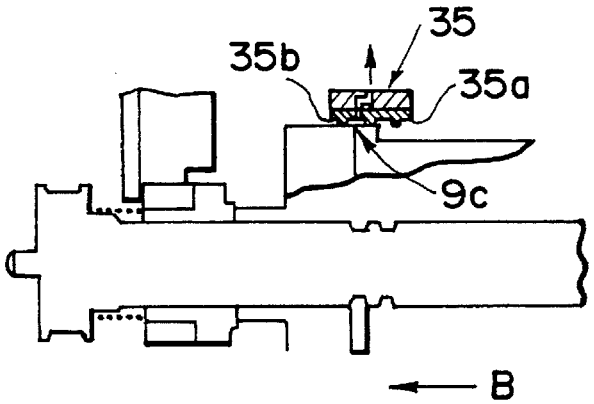

As shown in FIG. 11C, the cap during the recovery operation is such that the normal capping portion is deviated from the ejection side surface, by which the pressure is applied only to the ribs of the recovery cap. Then, the sealing effect is enhanced to assure the prevention of the leakage due to the vacuum. In this case, the meniscus is retracted due to the reduction of the inside volume by the capping, and therefore, there arises no problem by the sucking operation.

After the completion of the hermetical capping, the recovery operation is started upon which the sucking operation is performed.

Figure 13A:
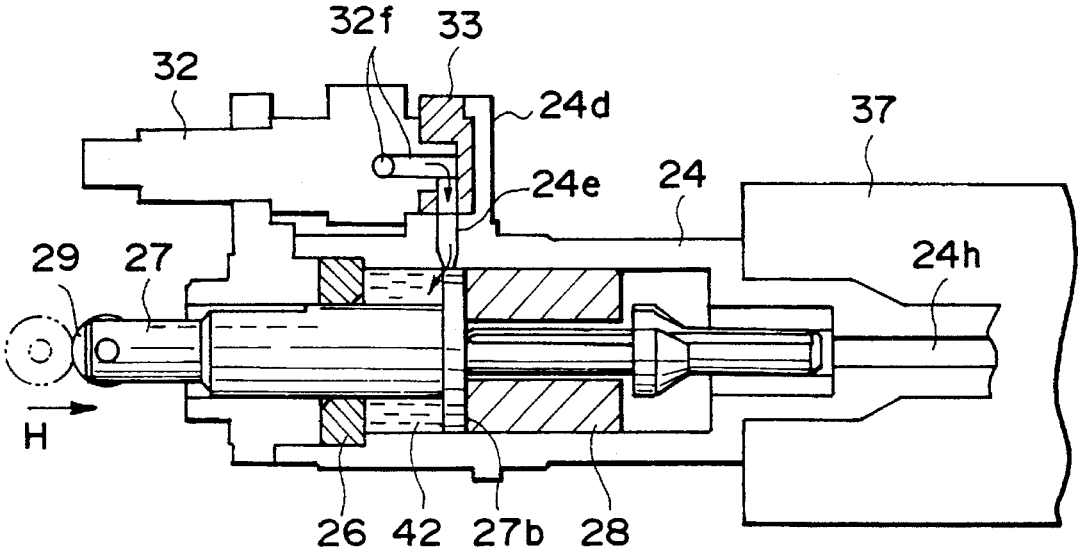
FIGS. 13A and 13B are sectional views illustrating operation of the sucking recovery pump.

By the rotation of the timing gear 21, the piston setting cam 21*f* urges the piston pushing roller 29 mounted on the piston shaft, and therefore, the piston shaft 27 is moved in the direction H, as shown in FIG. 13A. The piston 28 is urged by the piston stopper 27*b* to be moved in the direction H, and the pump chamber 42 is evacuated. There is a skin layer between the outer surface of the piston 28 and the piston stopper 27*b*, and therefore, the ink is not leaked through the communicating pores of the foamed material.

In addition, the ink passage 24*e* of the cylinder 24 is closed by the piston 27, and therefore, the vacuum in the pump chamber 42 is increased, but the piston 28 is movable. On the other hand, as shown in FIG. 13A, the ink passage 24*e* is opened after the recapping, so that, as shown in FIG. 11C, the ink is sucked through the sucking port 25*c* of the cap 35. The sucked ink is supplied through the ink passage 32*f* formed in the cap lever 32 and is fed through the communicating hole of the lever seal 33. The ink is further fed through the ink passage 24*e* of the cylinder 24 into the pump chamber 42. This continues until the vacuum produced by the volume change in the pump by the supply of the ink is eased.

When the timing gear 21 further rotates, the cap 35 is again slightly away from the ejection side surface by the action of the cap cam 21*e*, so that the ink is sucked from the space defined by the ejection side surface and sucking gap 35*b* by the remaining vacuum in the pump chamber, thus removing the ink therefrom.

Figure 13B:
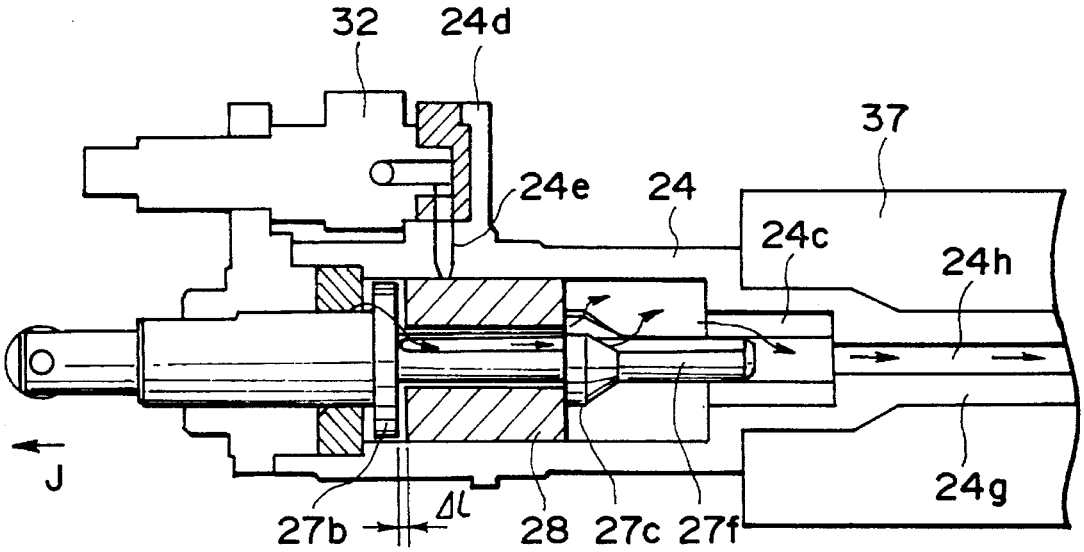

Subsequently, the timing gear 21 is rotated in the reverse direction, and then, the piston resetting cam 21*g* pulls the piston resetting roller 30. As shown in FIG. 13B, the piston shaft 27 is moved in the direction J. At this time, the piston 28 moves after the piston receptor 27*c* of the piston shaft 27 is contacted, and therefore, a clearance Δ l is produced between an end surface 28*b* of the piston and the piston stopper 27*b*.

By the movement of the piston shaft 27 and the piston 28, the residual ink in the pump chamber 42 is fed to the neighborhood of the center of the residual ink absorbing material 37 through the above-described clearance Δ l, the groove 27*f* of the piston shaft, the ink passage 24*c* of the cylinder 24 and the residual ink tube 24*g*. At this time, the ink passage 24*e* of the cylinder 24 is closed by the piston 28 at the initial stage of the piston 28 movement, and therefore, the residual ink is not reversely fed toward the cap.

Figure 14A:
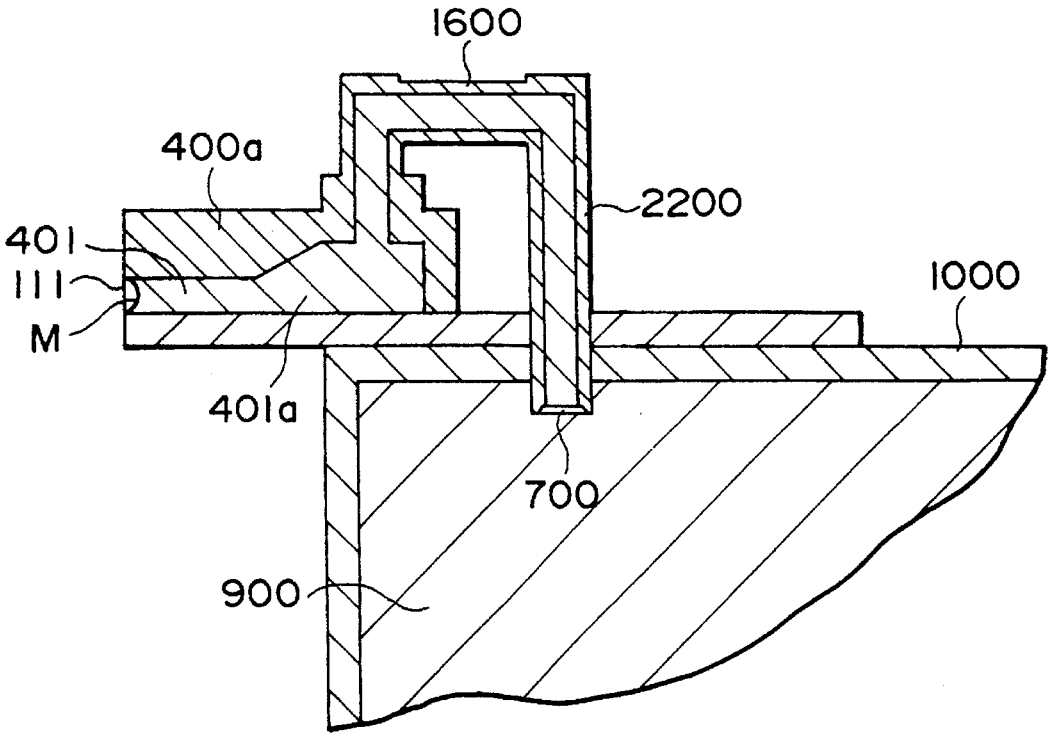
FIGS. 14A, 14B and 14C are sectional views of the ink jet cartridge in a normal condition, in the ink drop-out condition and in the insufficient ink condition, illustrating the filling of the ink in the ink jet cartridge, according to an embodiment of the present invention.
Figure 14B:
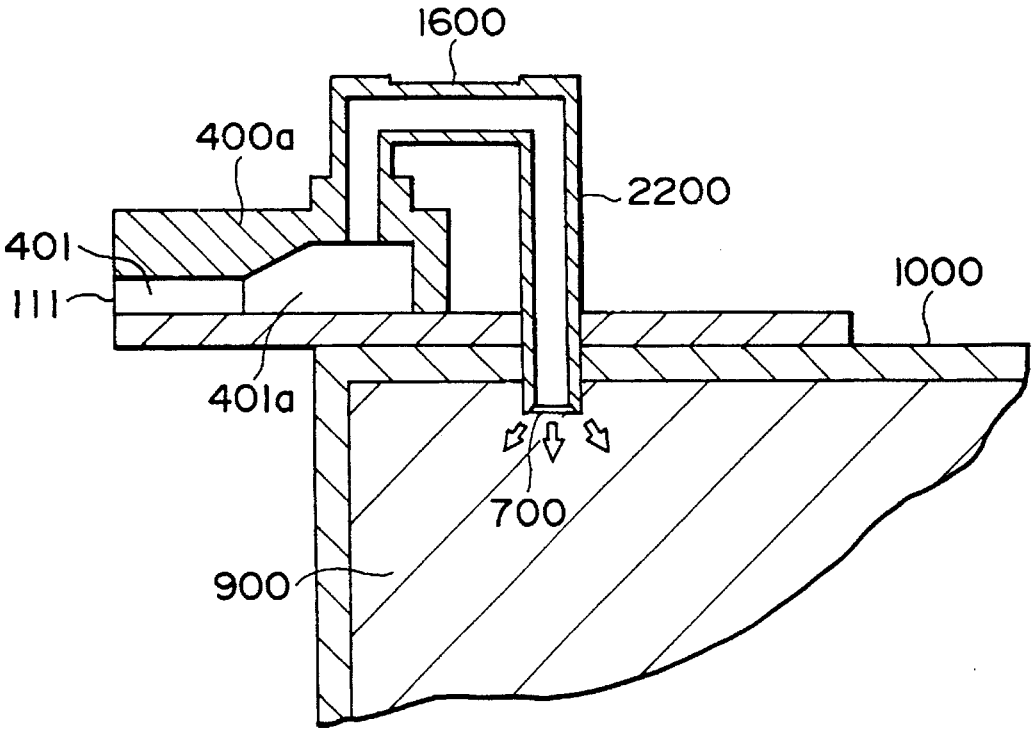

FIG. 14A is a sectional view of an example of an ink jet recording head having an integral ink container. In the normal state, as shown in FIG. 14A, the ink supplied from the ink container 1000 fills the respective ink passages 401 by the capillary action, and adjacent the ink ejection outlets 111, an ink meniscus M is stably formed at a position slightly retracted by the vacuum in the ink container 1000. In this state, the reduction of the ink in the ink passage 401 due to the ejection or discharge of the ink, is replenished by the capillary action exceeding the vacuum by the absorbing material 900 in this ink container, from the ink container 1000, upon each of the ejections. Thus, the ink can be ejected continuously. However, if the ink meniscus is broken at the ejection outlet 111 to such an extent that the common ink chamber 401*a* communicates with the ambience, as described hereinbefore, the ink in the ejection supply system in the ink ejector including the ink passage 401 is retracted into the ink container 1000 by the vacuum of the ink container 1000 with the result of ink vacancy, as shown in FIG. 14B. In this state, the ink is in contact with the filter 700. It is possible that the ink retained in the part of the absorbing material 900 which is press-contacted to the filter 700 is insufficient. For example, when the ink cartridge is kept unused for a long period of time under the condition in which the ink is easily evaporated, the evaporation of the solvent of the ink through the ejection outlets is continued, and in addition, the fine bubbles remaining in ink supply passage are developed, which may lead to the ink vacancy. When the cartridge is further left unused, the ink becomes insufficient even in the absorbing material 900. In this state, the ink ejection is practically not possible, and therefore, the recovery means has to be operated. In this embodiment, as described hereinbefore, the non-operable state is removed by the sucking action of the pump. Because of the following sucking operation, the operation recovers with certainty.

In this embodiment, the sucking quantity of the ink (liquid) by one forced discharging action is made larger than the inside volume of the entire ink passage of an ink jet unit, by which the ink is assuredly supplied to the plural ink passages 401 through the ink passage from the absorbing material 900 of the ink container. By doing so, even if the vacancy of the ink occurs, the recovery to the state shown in FIG. 14A is assured.

Figure 14C:
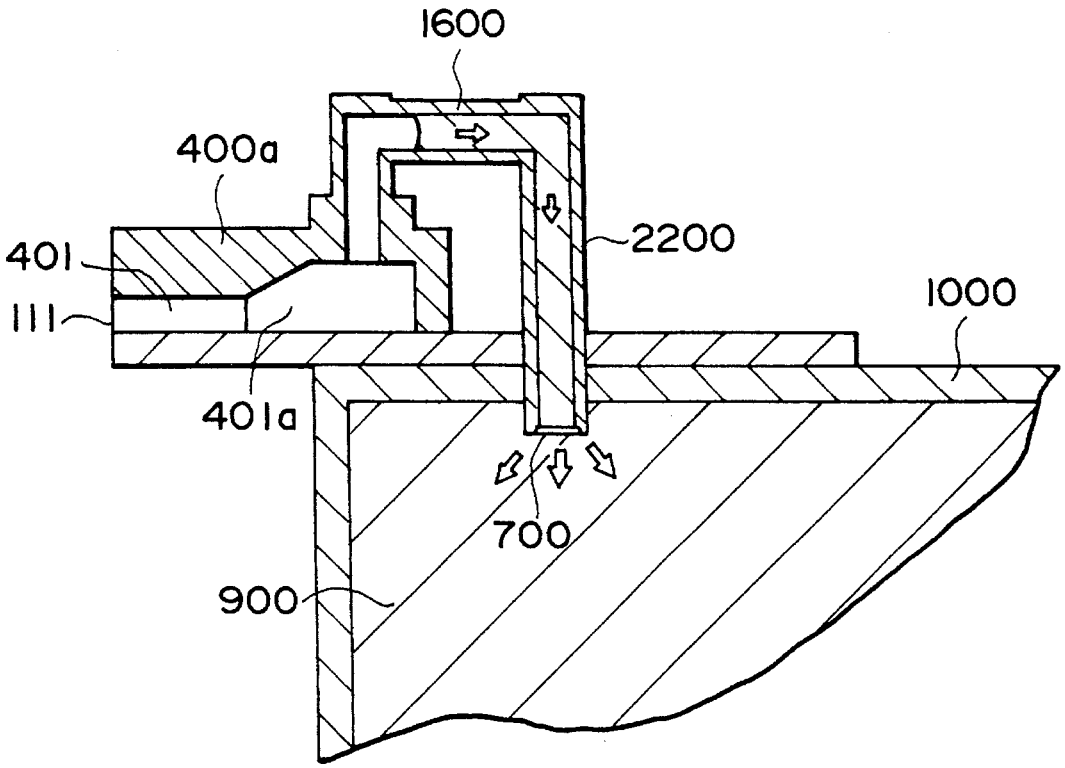

FIG. 14C shows as a comparison example the case wherein the sucking quantity by one action is reduced to one half. As will be understood from this Figure, the ink is once supplied to the middle of the ink passage from the ink container by the sucking action. However, the vacuum is required to be produced in the ink container side from the standpoint of proper function of the ink jet cartridge, and therefore, as shown by an arrow in the Figure, if the ejection outlet 111 communicates with the ambience after the sucking operation, the ink once supplied is returned into the ink container IT, with the result of the state of FIG. 14B being re-established. This is a problem peculiar to an ink jet head cartridge. Where a non-replaceable scanning recording head is connected with an ink container fixed at a predetermined position of the main assembly of the recording apparatus, and connected with a supplying tube such as a long tube having a small diameter, the ink container may be disposed at a level lower than the ejection outlets to provide a negative static head adjacent the ejection outlets to stabilize the ink ejections, upon which the similar ink retraction may be produced. However, actually, the resistance of the ink supply tube passage is so large that it does not occur. Therefore, normal sucking action is sufficient to recovery the apparatus with certainty.

The effects of this embodiment will be described with data. The ink jet cartridge had 64 ejection outlets to provide 360 dpi (dot per inch) images. The ink cartridge ejected 75 Pl (pico-liter)/drop at a maximum driving frequency of 3 KHz. The ink container contained 25 cc of the ink, wherein the volume of the ink supply system of the head was 0.07 cc. The pump 50 had the capacity shown in Table 1 below. The experiments was carried out in which the ink vacancy is removed by the recovery action.

TABLE 1

| | Vol. change in sucking portion | Sucking quantity under normal condition | Degree of recovery | Print after recovery |
|---|---|---|---|---|
| Example 1 | 0.300 (cc) | 0.280 (cc) | G | F |
| Example 2 | 0.230 | 0.210 | G | G |
| Example 3 | 0.170 | 0.140 | G | G |
| Example 4 | 0.100 | 0.070 | G | G |
| Comparison Example 1 | 0.090 | 0.060 | U | N |
| Comparison Example 2 | 0.070 | 0.040 | N | No print |
| Comparison Example 3 | 0.060 | 0.020 | N | No print |

G: Good
F: Fair
U: Unstable
N: No good

The experiments have revealed that if the sucking quantity is larger than the entire volume of the supply system, the ink can refill it, whereas if it is smaller, the refilling is not stabilized. If it is even smaller, the refilling was not possible. As regards the printing quality after the refilling, it is not satisfactory when the sucking quantity is small even if the refilling is possible with insufficient stability. In the experiments, when the sucking quantity exceeds three times, the printing quality is slightly degraded. The reason is considered as follows. In this ink Jet cartridge, if the ink discharging quantity per unit time by the forced discharging means such as sucking means exceeds the moving quantity at which the ink can be moved and supplied to the ink supply port per unit time from the ink container IT, the supply of the ink through the filter 700 is not sufficient with the possible result that the fine bubbles in the ink absorbing material 900 in the ink container are introduced into an ink jet unit (ink ejector). In the experiments, the rate of the ink flow through the filter 700 was measured in connection with the above phenomena. An instantaneous maximum ink discharging rate from the ink container not resulting in the above phenomena was 0.6 cc/sec. As a result of calculation on the basis of the area of the filter 700, it has been found that the ink flow rate at the filter is preferably not more than 0.2 cc/sec.mm$^2$. Therefore, in order to avoid the above phenomena, the cross-sectional area of the filter 700 may be increased to reduce the ink flow rate (speed) per unit area and per unit time. It is advantageous to increase the mobility of the ink in the ink container by changing the configuration or material of the absorbing material 900 in the ink container.

From the standpoint of assuring the sufficient quantity of the ink to the ink ejector, the sucking quantity is preferably 1–3 times the volume of the ink path.

Figure 15:
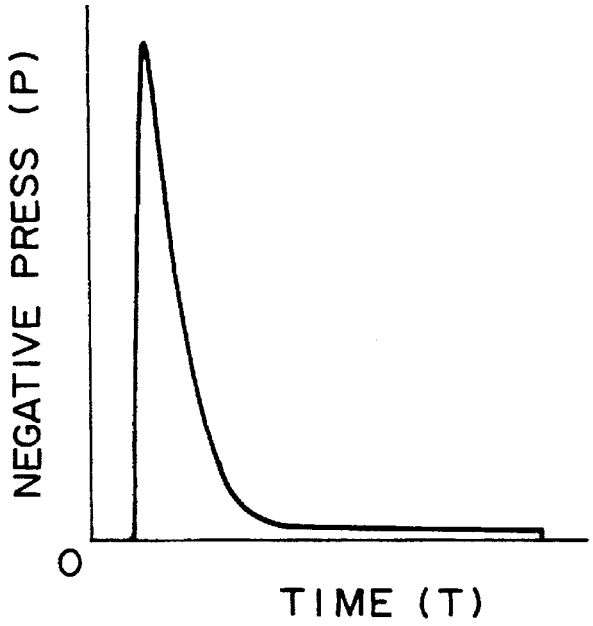
FIG. 15 is a graph of a vacuum in the pump vs. time during the pump sucking operation.

FIG. 15 shows a waveform of a pump pressure during the sucking recovery operation. It will be understood that by the introduction of the ink, the vacuum pressure in the pump is reduced. In this Figure, a slight vacuum remains in the latter part of the sucking operation because the ink introduction amount is reduced by the resistance of the ink passage 401 or the like and the vacuum of the ink container IT, and because the meniscus acts such that the ink does not flow at a high speed by sucking a small pressure difference.

In this example, the cap is released finally to release all the negative pressure. In this embodiment, the forced discharging means is in the form of sucking means. This is not limiting if the ink can be supplied to the ink ejector, for example, a pressing means is usable for applying pressure through the air vent to push the ink to the ink ejector.

The provision of the recovery means and the preliminary means for the recording head are preferable to further stabilize the present invention. In addition to the pressing or sucking means as the forced discharging means, the provision of capping means, cleaning means, preliminary heating means using either the electrothermal transducer or a separate heating element, and preliminary ejecting means for ejecting the ink not for the printing are preferable to stabilize the recording.

The structure of the ink jet cartridge per se is not limited to the disclosed embodiment. The present invention is applicable if the meniscus is stably maintained by the sucking pressure of the ink container and if an ink passage is used to connect the ejection outlets 111 and the ink container IT. For example, as regards the recording head body constituted by the heater board 100 and the top plate 400, the recesses constituting the ink passages and the common liquid chamber are formed only in the top plate, but they may be formed in both of them.

Figure 16A:
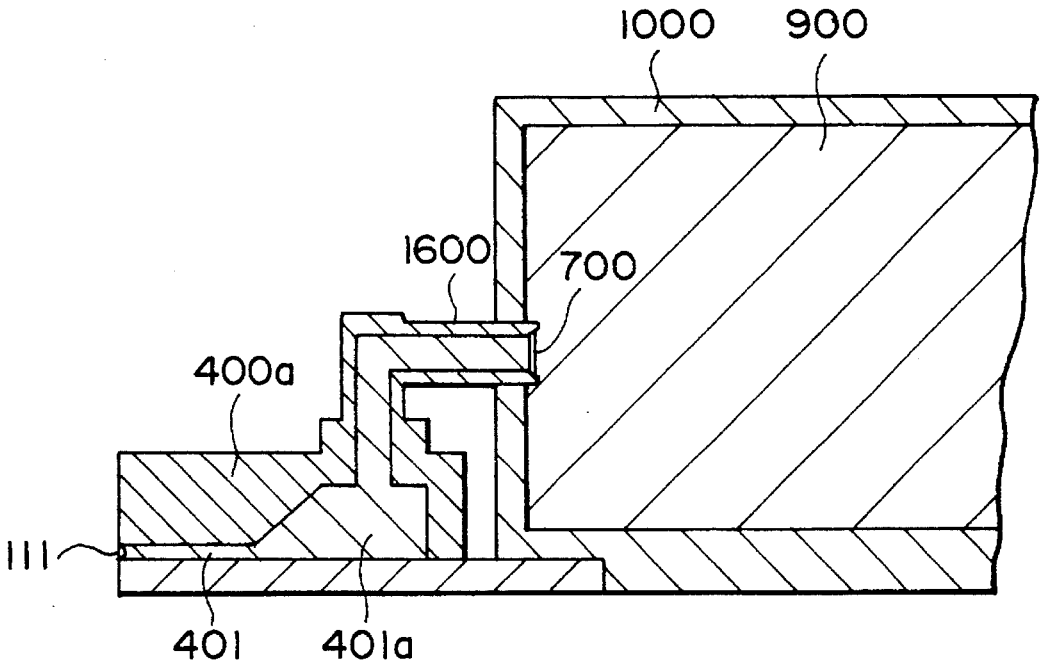
FIGS. 16A, 16B and 16C are sectional views of an ink jet cartridge in a normal state, upon completion of the sucking operation and in the ink drop-out state, according to an embodiment of the present invention.
Figure 16B:
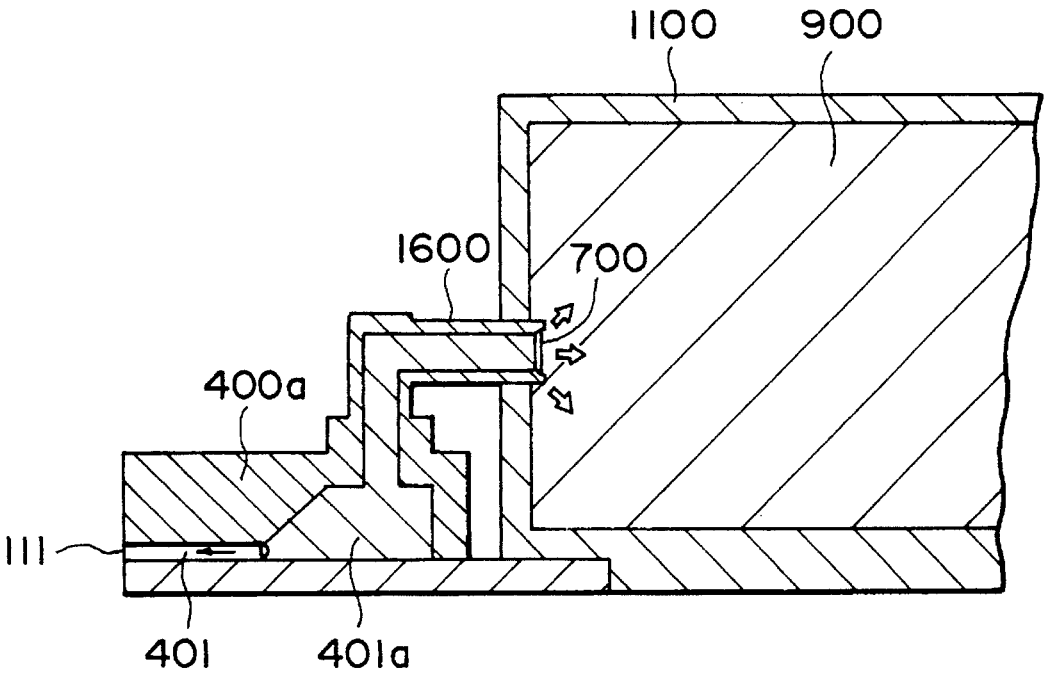
Figure 16C:
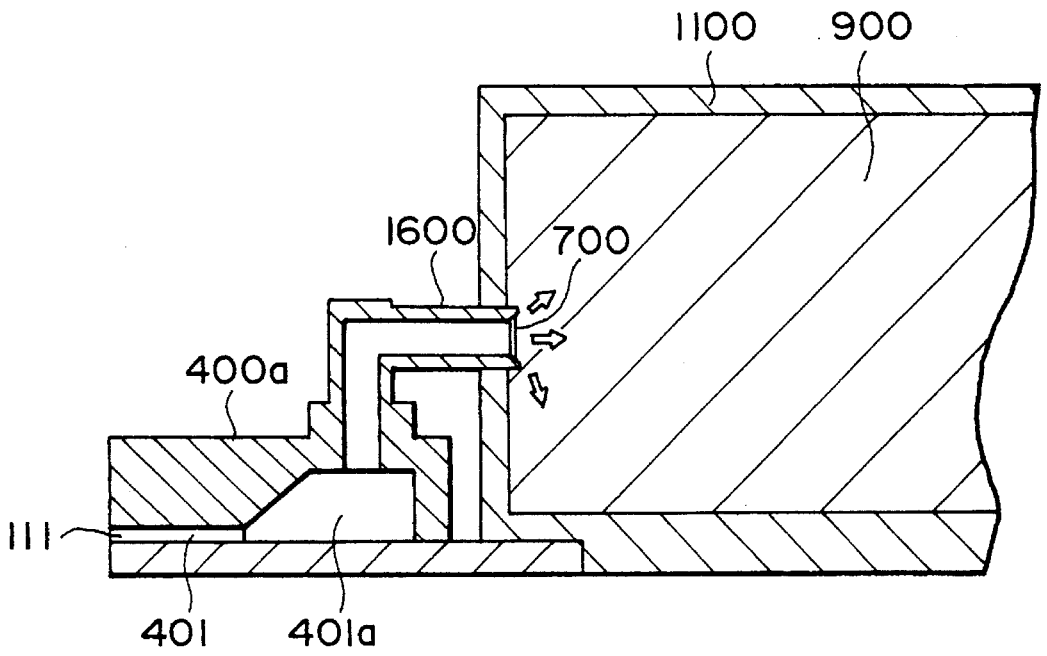

Referring to FIGS. 16A, 16B and 16C, another embodiment will be described. In this embodiment, the ink jet cartridge has a smaller cross-sectional area of the ink passage to promote the ink refilling by the capillary action. In this embodiment, the sucking quantity of the forced discharging means is made larger than the inside volume of the ink passage except the plural ink passages 401. This is because the inside volume of the ink passages 401 is negligibly small as compared with the inside volume of the ink passage containing the common ink chamber 401*a* and the like. The ink jet cartridge IJC used in this test has 128 ejection outlets capable of providing an image with 400 dpi. The volume of the droplet ejected is 28 Pl/drop. They are produced at the maximum driving frequency of 4 KHz. The ink capacity (net) was 35 cc, and the inside volume of the ink passage was 0.06 cc. FIGS. 16A, 16B and 16C show the ink refilling process. The recovery operation of this embodiment changes the FIG. 16C state (ink vacancy) to FIG. 16A state. As shown in FIG. 16B, the ink is refilled to the extent of the common ink chamber 401*a* side of the ink passages 401. In this case, the ink can be refilled to the ejection outlets 111 by the strong capillary action. The printing quality after the recovery was good.

Figure 17:
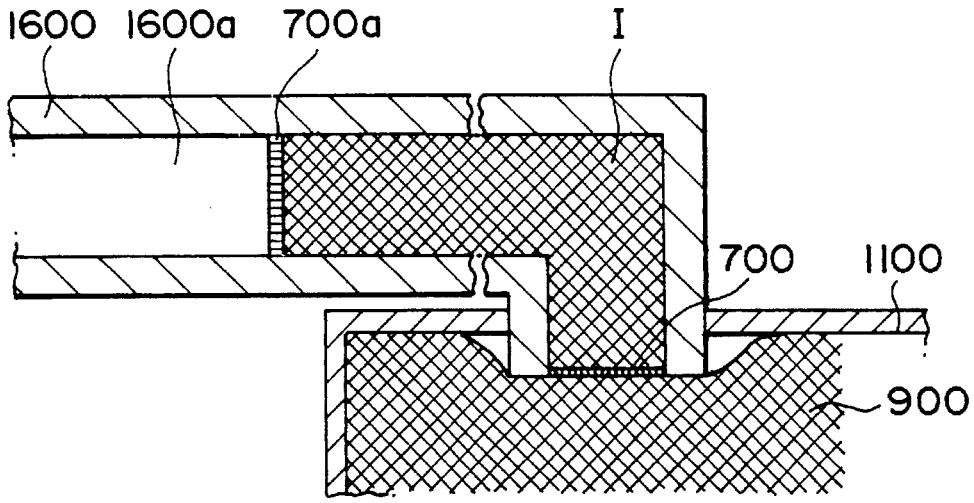
FIG. 17 is a sectional view of a part of an ink jet recording head, according to another embodiment of the present invention.

FIG. 17 illustrates a further embodiment, wherein an additional filter 700*a* is provided in the ink supply passage 1600*a* in addition to the filter 700 at the position of contact with the ink absorbing material 900. The position of the filter 700*a* is not limited but is preferably between a junction between the top plate 400A with grooves and the ink supply tube 1600 and a junction between the ink supply tube 1600 and the ink container 1100. The inside volume of the ink passage in the ink jet unit in the ink jet cartridge is 0.08 cc.

The sucking capacity of the sucking pump is 0.05–0.06 cc per one sucking action.

Assuming that the filter 700*a* is not provided, the ink would not be easily refilled throughout the entire ink jet unit even if the sucking recovery action is repeated. This is because, the ink I is sucked to the halfway point in the ink supply passage 1600*a*, but as soon as the sucking action is released, the negative pressure of the absorbing material 900 retracts the ink. In this embodiment, there is provided a filter 700*a* in the ink supply passage 1600*a*, and the volume between the filter 700*a* and the filter contacted to the absorbing material 900 is made smaller, for example, 0.04 cc, than the sucking quantity by the ink per one sucking action. The ink can not be sucked to the ejection outlet of the ink ejector by one sucking action, but when the ink is retracted by the vacuum in the absorbing material 900, a meniscus is formed in the mesh of the filter 700*a*. The meniscus retaining force is stronger than the negative pressure of the absorbing material 900, and therefore, the ink is retained in the filter 700*a*, so that the ink is not retracted to the ink container. In addition, the inside volume between the filter 700*a* and the ejection outlets 111 of the ink ejector is approximately 0.04 cc, and therefore, the ink is sucked to the ejection outlet 111 of the ink ejector by the second sucking action with certainty. Thus, the ink meniscus is assuredly formed at the ejection outlets 111, and therefore, the entire ink passage is filled with the ink, thus enabling the printing. The filter 700*a* in the ink supply passage 1600*a* is disposed at a proper position in consideration of the inside volume of the ink supply passage and the pump capacity of the sucking recovery pump. The number of the filters 700*a* is not limited to one. If the bubbles are between the absorbing material 900 and the filter 700 in contact with the absorbing material 900 during the ink vacancy, a sum of the volume of the bubbles and the inside volume of the ink supply passage of the head unit is the virtual inside volume of the ink passage. This may be added to the pump capacity as a margin with the result of higher reliability.

According to this embodiment, a smaller capacity sucking pump is usable, by which the size of the apparatus can be reduced. In addition, the flow rate of the ink through the filter 700 per one sucking action can be reduced, and therefore, the introduction of bubbles from the ink container is reduced.

In this ink jet cartridge, if the ink discharging quantity per unit time by the forced discharging means such as sucking means exceeds the moving quantity at which the ink can be moved and supplied to the ink supply port per unit time from the ink container IT, the supply of the ink through the filter 700 is not sufficient with the possible result that fine bubbles in the ink absorbing material 900 in the ink container are introduced into an ink jet unit (ink ejector). In the experiments, the rate of the ink flow through the filter 700 was measured in connection with the above phenomena. An instantaneous maximum ink discharging rate from the ink container not resulting in the above phenomena was 0.6 cc/sec. As a result of calculation on the basis of the area of the filter 700, it has been found that the ink flow rate at the filter is preferably not more than 0.2 cc/((sec)(mm$^2$)). Therefore, in order to avoid the above phenomena, the cross-sectional area of the filter 700 may be increased to reduce the ink flow rate (speed) per unit area and per unit time, by decreasing the pump sucking volume.

In this embodiment, the inside volume of the ink passage of the ink jet head is 0.08 cc; the sucking quantity per one sucking action of the pump is 0.05–0.06 cc; and the filter is disposed at such a position as to provide 0.04 cc volume with the ink container side end of the passage.

The figures are not limiting, and they may be determined on the basis of the inside volume of the ink supply passage of the head unit and the sucking quantity per one sucking action of the sucking pump.

If the filter is disposed at a position providing a volume exceeding the sucking quantity per one sucking action, the vacancy of the ink may occur, and therefore, it is preferable that the filter is disposed at such a position providing the volume smaller than the sucking quantity of the sucking pump.

It is preferable to satisfy $V_D > V_I$, where $V_D$ is the sucking quantity per one sucking action of the sucking pump, $V_I$ is a volume between the filter 700 in the ink container and the filter 700*a* to increase the flow resistance and to provide the meniscus.

Figure 18A:
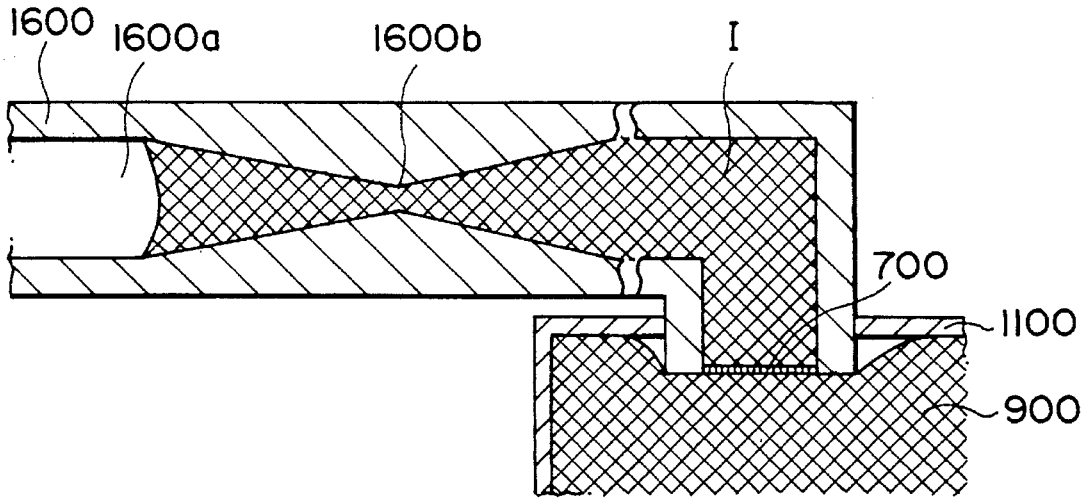
FIGS. 18A and 18B are sectional views of a major part of the ink jet recording head according to a further embodiment of the present invention.
Figure 18B:
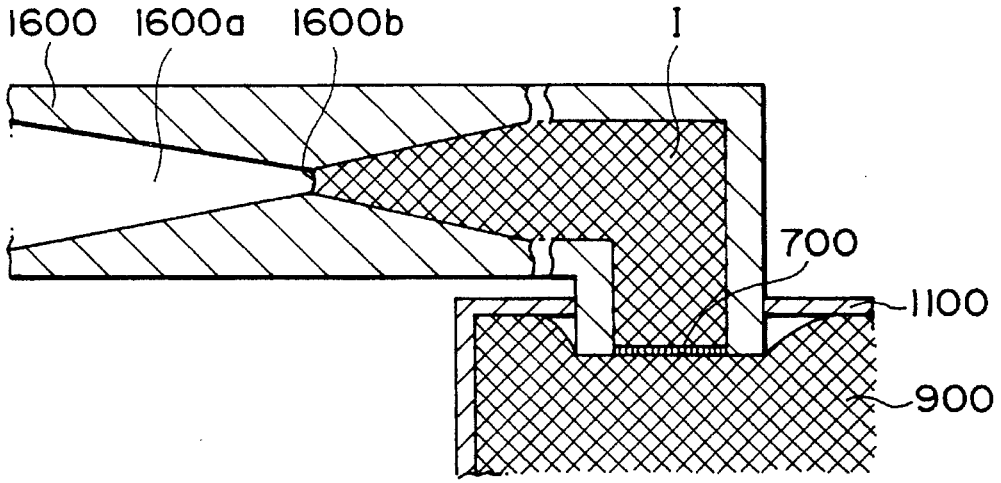

FIGS. 18A and 18B show a further embodiment. As described hereinbefore, bubbles are produced in the ink supply passage when the recording head is left unused, and the bubbles move toward the ink passage with the result of vacancy in the ink passage and the improper ink ejection. In order to permit the ink flow even if a certain amount of bubbles are produced in the passage, the cross-sectional area of the ink passage 1600*a* is relatively large. By doing so, however, the inside volume of the ink passage of the head unit becomes large.

As shown in FIGS. 18A and 18B, in this embodiment, the cross-sectional area of the ink passage 1600*a* is reduced at a certain position to provide a smaller diameter portion 1600*b*. When the circumferential length of the inside of the ink supply passage 1600*a* is long, the meniscus retaining force, if any, is small, so as not to prevail the negative pressure of the absorbing material with the result that the ink is retracted to the ink absorbing material 900. However, if the circumferential length of the tube of the ink supply passage 1600*a* is reduced, that is, the cross-sectional area is reduced, the flow resistance is increased with the advantage of a higher meniscus retaining force, and therefore, the ink is not retracted. In order to suppress the damage attributable to the production of the bubbles, it is not possible to reduce the diameter throughout the ink supply passage. In consideration, only a predetermined portion is given the small diameter. In this case, the smallest portion has the diameter not more than 0.5 mm. The figure is not limiting, and may be determined on the basis of the meniscus retaining force and/or production and movement of the bubbles. Volume between the smallest cross-sectional area portion of the ink supply passage 1600*a* and the filter 700 in contact with the absorbing material 900 in the ink container is smaller than the sucking quantity of the pump, so that the ink can be filled with certainty in the region from the small cross-sectional area portion of the ink supply passage 1600*a* to the common ink chamber by one sucking action, even if the total volume of the ink supply passage in the unit is larger than the pump sucking capacity (FIG. 18A). The ink is retracted by the vacuum attraction force of the ink absorbing material 900, but because of the high flow resistance of the small cross-sectional area portion, it is retracted at a slow speed. In addition, the meniscus retaining force is strong in the smaller diameter portion, as shown in FIG. 18, and therefore, the reverse flow of the ink to the ink container can be prevented. Since the inside volume from the small diameter portion of the ink supply passage 1600*a* to the recording head nozzle is smaller than the sucking quantity of the pump, and therefore, the ink can be supplied to fill the entire passage in the recording head unit by two sucking actions. In this embodiment, the ink supply passage does not require the additional element (filter) as in the preceding embodiments, and therefore, the manufacturing cost can be further decreased.

In this embodiment, even if the diameter (cross-sectional area) is not reduced to such an extent that the ink supplied by the first sucking action is completely retained, the same advantageous effects can be provided if the quantity of the ink retracted into the ink container until the second sucking action is so small that the volume to be filled by the second sucking action is smaller than the pump sucking quantity.

Figure 19:
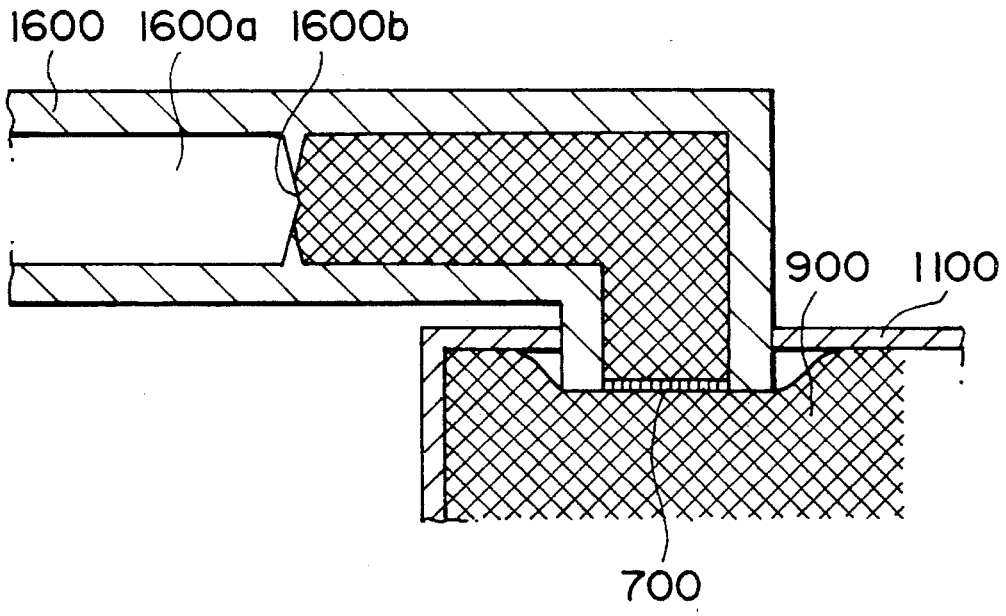
FIG. 19 is a partial sectional view of a major part of the ink jet recording head according to a further embodiment of the present invention.

FIG. 19 shows a further embodiment, wherein the ink supply passage 1600*a* is provided with a local projection or projections to reduce the ink supply passage diameter to provide a larger flow resistance. By selecting the configuration of the projection so as to provide easier maintenance of the meniscus, the same advantageous effects as in the foregoing embodiment is provided.

In the foregoing embodiments, if ink sensor electrodes are provided at the position of the filter, small diameter portion or the projections to permit measurement of the electric resistance between the electrodes, it is possible to sense whether the ink exists at the position of the filter, the small diameter portion or the projections.

Figure 20:
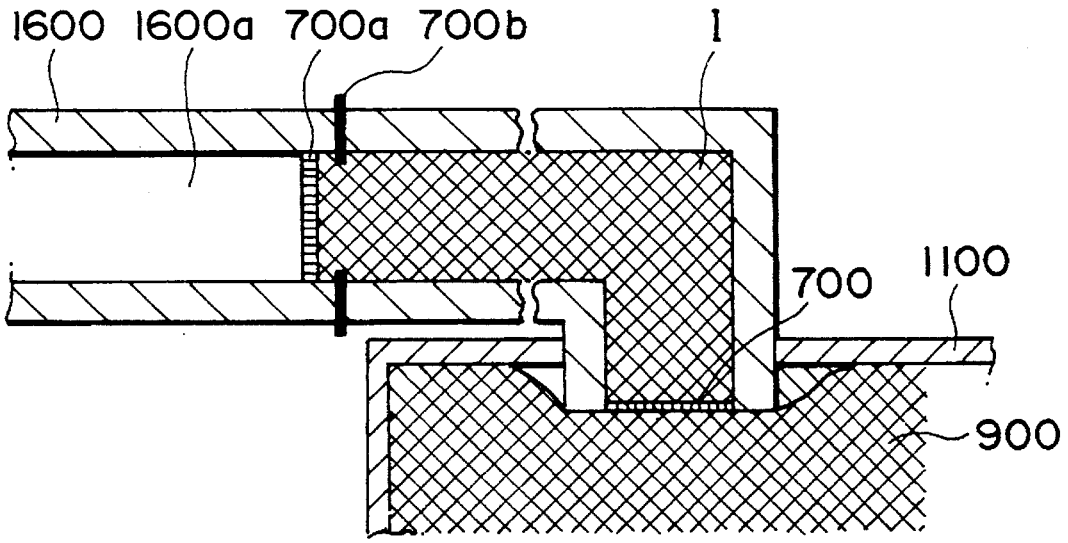
FIG. 20 is a partial sectional view of a major part according to a further embodiment of the present invention.

FIG. 20 shows an embodiment wherein the electrodes are provided adjacent the filter. Then, where the ink is detected at the filter position, the small diameter position or the projection position, one sucking action is carried out, and if the ink does not exist there, a predetermined number of sucking actions are carried out. By doing so, the ink can be sucked efficiently with certainty and without waste, to recovery the recording head.

In this embodiment, if the filter and the projections are used as an ink trap, it is possible to use the projections themselves as the electrodes. The ink sensor described hereinbefore is of such a type that the resistance between the electrodes is measured. However, the sensor is not limited to such a type, if the presence and absence of the ink can be detected.

As described in the foregoing, according to the foregoing embodiments, there is provided an ink jet cartridge having an integral ink supply container and recording head unit, wherein an ink trap is provided by use of a filter or by providing a small cross-sectional area (by reducing cross-sectional area or by projection) to increase the resistance against the flow in the ink supply passage, the head unit can be filled with the ink by several sucking actions even if the pump capacity of the sucking recovery pump of the ink jet recording apparatus is smaller than the inside volume of the recording head unit. Therefore, the necessity for the requirement of a sucking pump of large capacity in the ink jet recording apparatus is eliminated. Accordingly, the reduction of the size and cost of the apparatus is made easier. It is possible that the ink sensor is provided at the filter position, the small diameter position or the projection, the number of pump actions can be changed between the recovery operation against the ink vacancy and the recovery operation against the clogging of the ejection outlet by the solidification of the ink, by which the ink can be efficiently used, and therefore, the running cost can be reduced.

Figure 1:
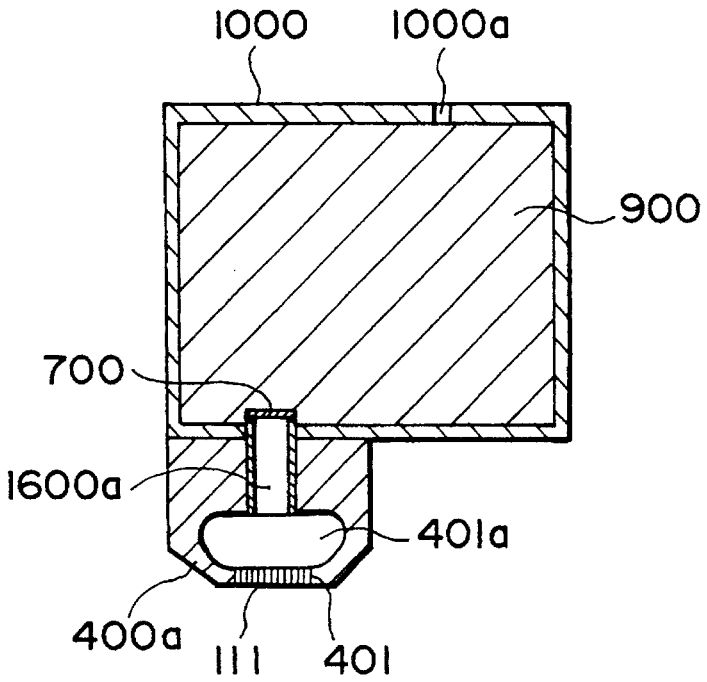
FIG. 1 is a sectional view of a recording head.
Figure 21:
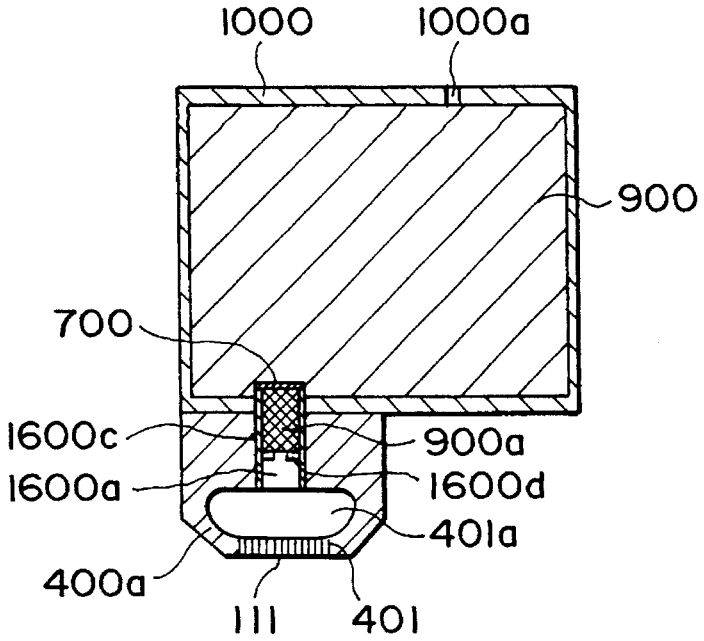
FIG. 21 is a sectional view of a recording head having an integral ink container, according to a further embodiment of the present invention.

FIG. 21 illustrates a recording head having an integral ink container according to a further embodiment. The same reference numerals as in FIG. 1 are assigned to the elements having the corresponding functions. In this Figure, an ink absorbing material 900*a* is compressed into a cylindrical member 1600*c* having therein an ink supply passage 1600*a* and is supported at an end by a supporting member 1600*d* in the form of a rib or the like. Since it is compressed into the ink supply passage 1600*a*, it is press-contacted to the filter 700.

Figure 22:
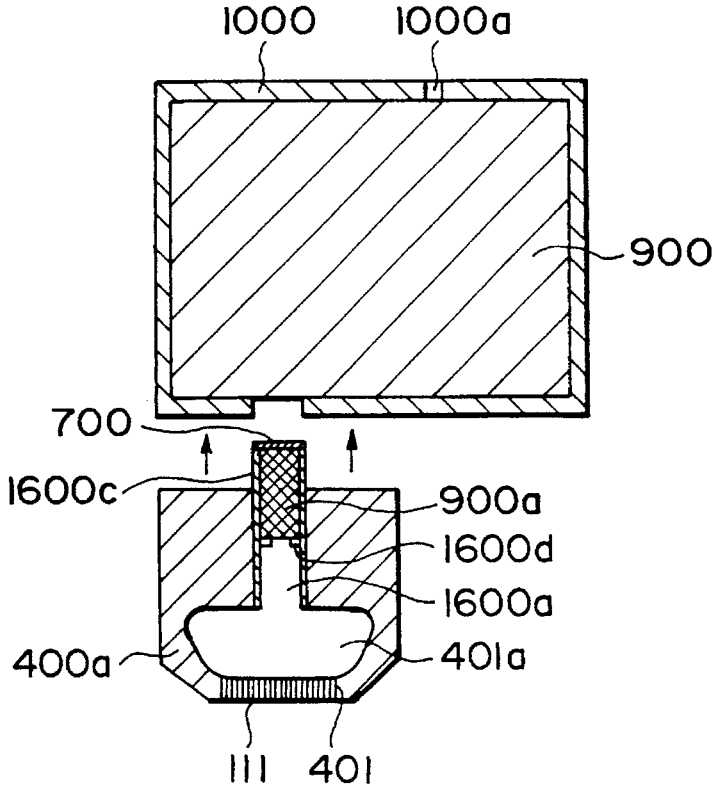
FIG. 22 is a sectional view illustrating assembling of the recording head of FIG. 21.

As shown in FIG. 22, the head unit 400*a* and the ink container 1000 are coupled by inserting the cylindrical portion 1600*c* while compressing the absorbing material 900 to the portion where the ink absorbing material 900 in the ink container 1000 is exposed. The coupling therebetween is retained mechanically or by a bonding agent. Thus, the ink absorbing material 900 in the ink container 1000 and the ink absorbing material 900*a* in the head unit 400*a* are contacted and joined through the filter 700.

Since the absorbing material 900 is compressed at and adjacent the connecting portion with the head unit 400*a*, and therefore, the sucking force is larger than the portion which is not compressed. The sucking force of the absorbing material 900*a* is so selected that it is substantially equal to or larger than the sucking force at or adjacent the connecting portion with the head unit 400*a* side of the absorbing material 900. Then, because of the pumping action due to the difference in the absorbing force, the absorbing material 900*a* is always retained under an ink rich condition.

Because of these structures described above, the ink in the absorbing material 900 can be efficiently used. In addition, even if an ink vacancy state is produced, the ink rich state of the absorbing material 900*a* is effective to prevent the introduction of the bubble into the absorbing material 900*a*, and the virtual air volume can be reduced inside the ejection outlet, and therefore, the sufficient recovery action is possible even if the pump capacity is relatively small.

As for the material of the absorbing material 900*a*, formed polyurethane or the like is preferable, but it is not limiting. The material of the absorbing material 900 may be similar to that of the absorbing material 900*a* or may be different such as Lubcell available from Toyo Polymer Kabushiki Kaisha, Japan.

The structure of this embodiment is particularly effective when the recording head has an integral ink container, and the ink supply passage 1600*a* is relatively long, and therefore, the inside volume is relatively large.

According to this embodiment, even if the ink vacancy occurs, not all of the ink in the ink passage 1600*a* is lost, and therefore, the virtual gas volume can be reduced, so that the capacity of the pump can be reduced, wherein one stroke operation of the pump is sufficient to recover the recording head.

Figure 23:
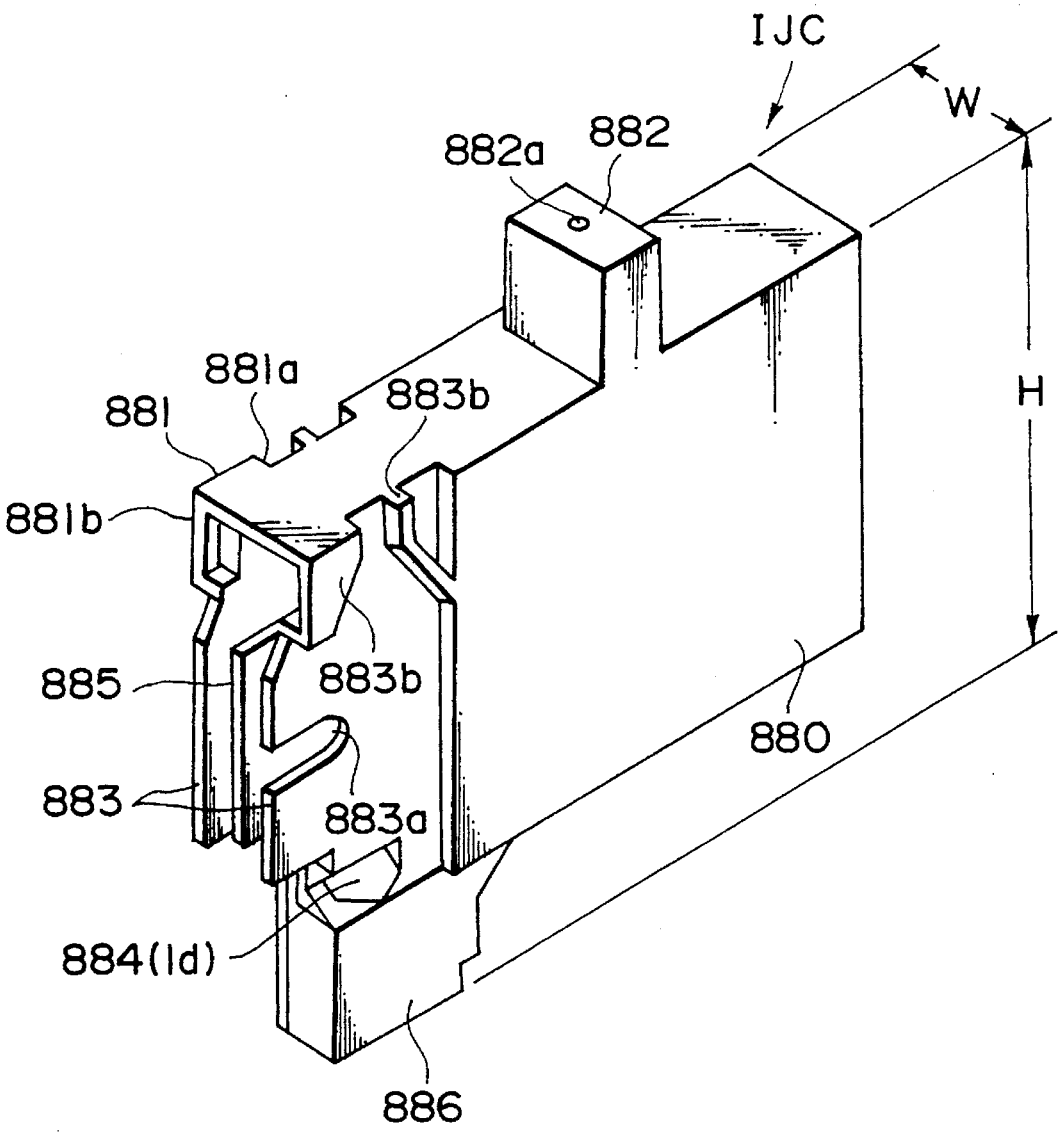
FIG. 23 is a perspective view illustrating an outer appearance thereof.

FIG. 23 is a perspective view of an ink jet cartridge having an integral ink container detachably mountable to a carriage of an ink jet recording apparatus which will be described hereinafter in conjunction with FIG. 24.

The ink jet cartridge IJC according to this embodiment has an upper ink container 880 and a lower head unit 886 and a head side connector 885 for receiving the driving signal or the like for the head unit 886 and for detecting an output of an ink remaining amount sensor. The head side connector 885 is juxtaposed with the ink container 880. Therefore, when the cartridge IJC is mounted on the carriage, the height H can be reduced. By reducing the width in the cartridge scanning direction so that plural cartridges IJC are juxtaposed, the carriage can be made smaller.

A connector cover 883 is formed integrally with an outer wall of the ink container and functions to prevent erroneous contact to the connector 885. Designated by a reference numeral 881 is a positioning portion in which abutment surfaces 881*a* and 881*b* in the two directions are formed. By providing sufficient distance between the positioning surfaces and the positioning abutment surfaces on the head chip unit 886, the recording head can be positioned correctly by pressing it with a pushing pin to a slanted surface 884. A grip 882 is used when the cartridge IJC is mounted or dismounted. An air vent 882*a* is formed in the grip 882 to communicate the inside of the ink container 880 with the ambience. A cut-away portion 882 and a guide 883*b* are used as guides when the cartridge IJC is mounted.

The head unit 886 of this embodiment has a plurality of ejection outlets in the bottom surface. The liquid passages communicating with the ejection outlets are provided with energy generating elements for generating energy contributable to the ejection of the ink. The energy generating element is preferably an electrothermal transducer element since the density of the ejection outlets or the liquid passages can be increased.

Figure 24:
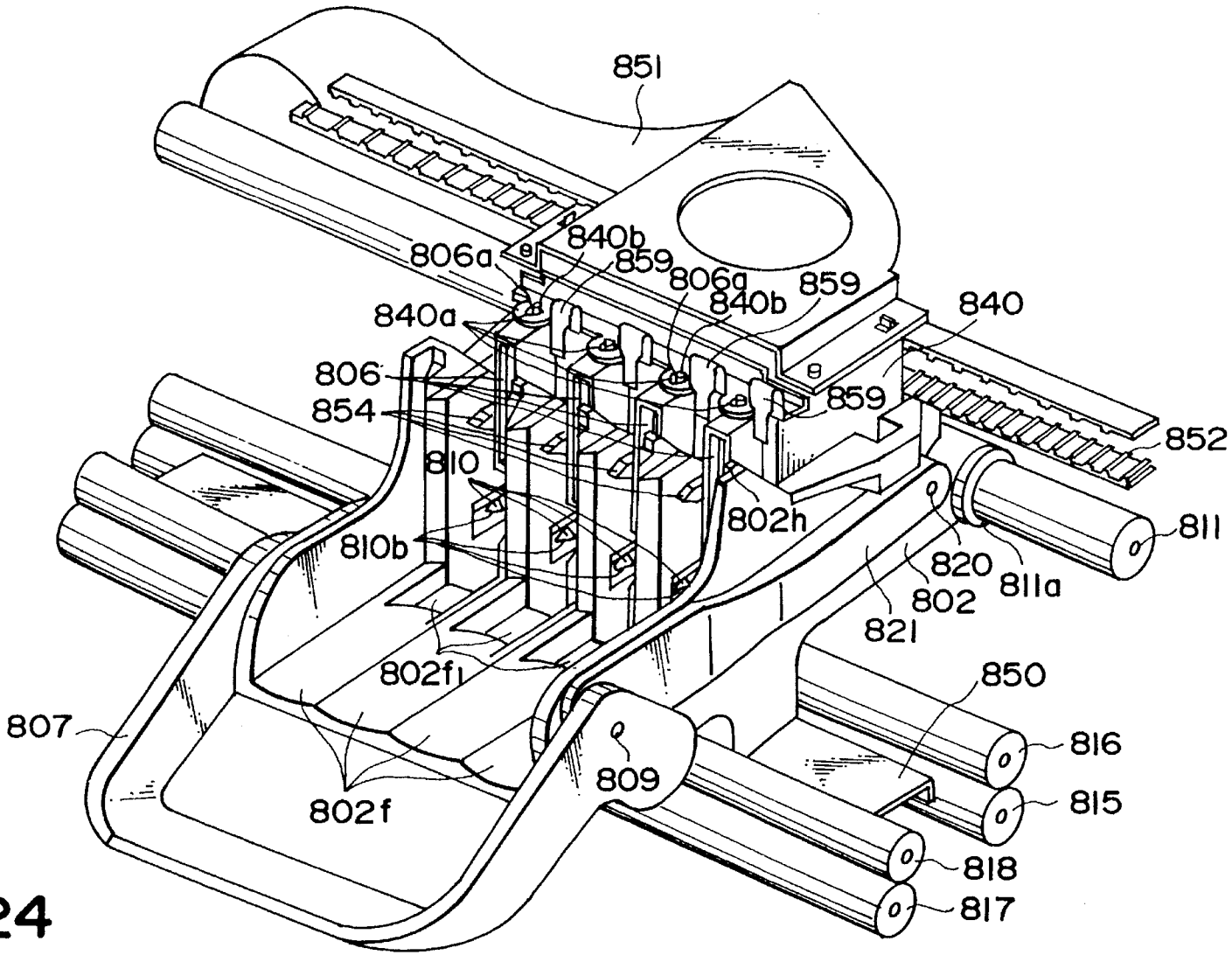
FIGS. 24 and 25 are a perspective view and a top plan view illustrating the mounting portion of the recording apparatus for receiving the recording head shown in FIG. 23.
Figure 25:
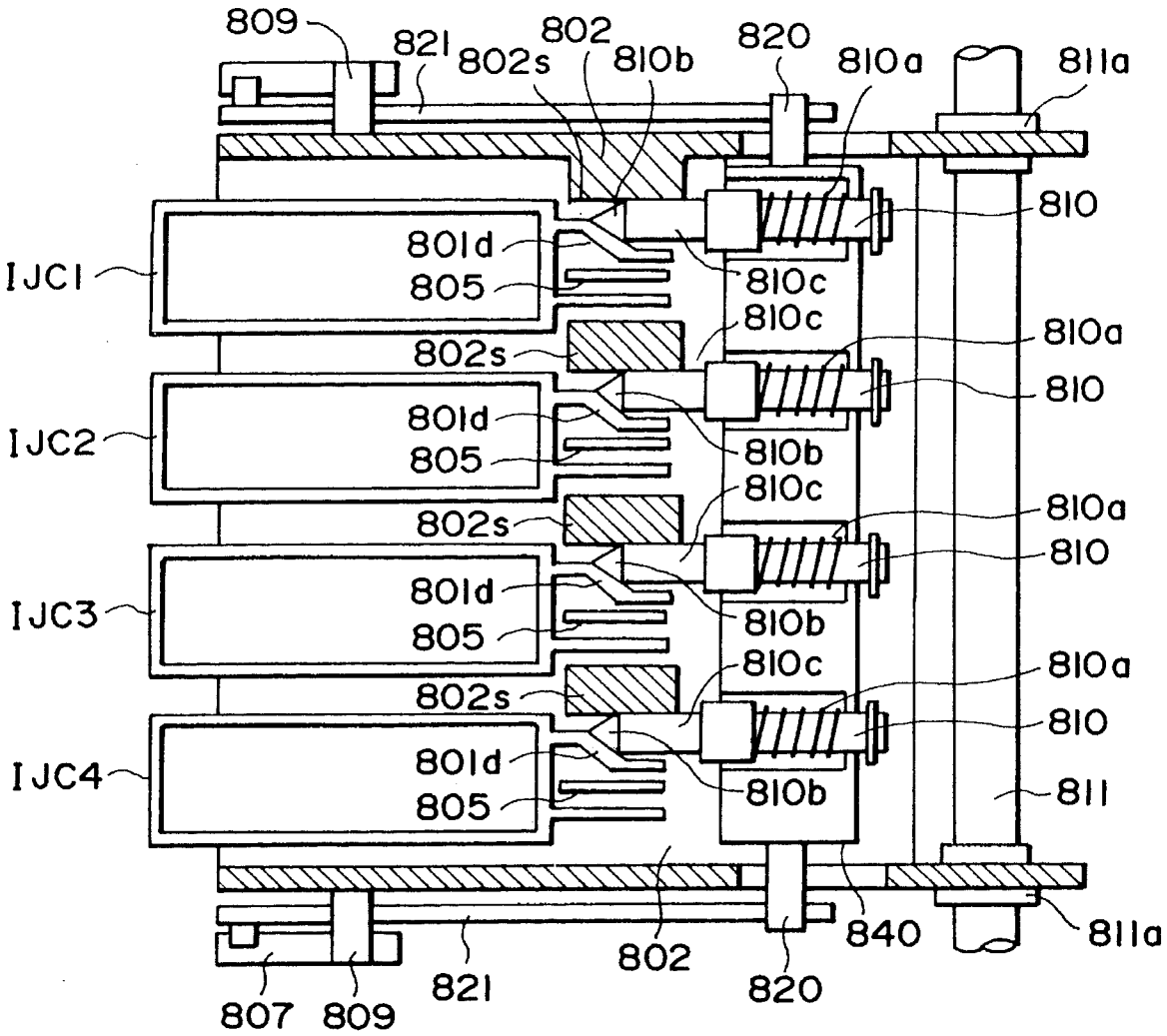
Figure 26:
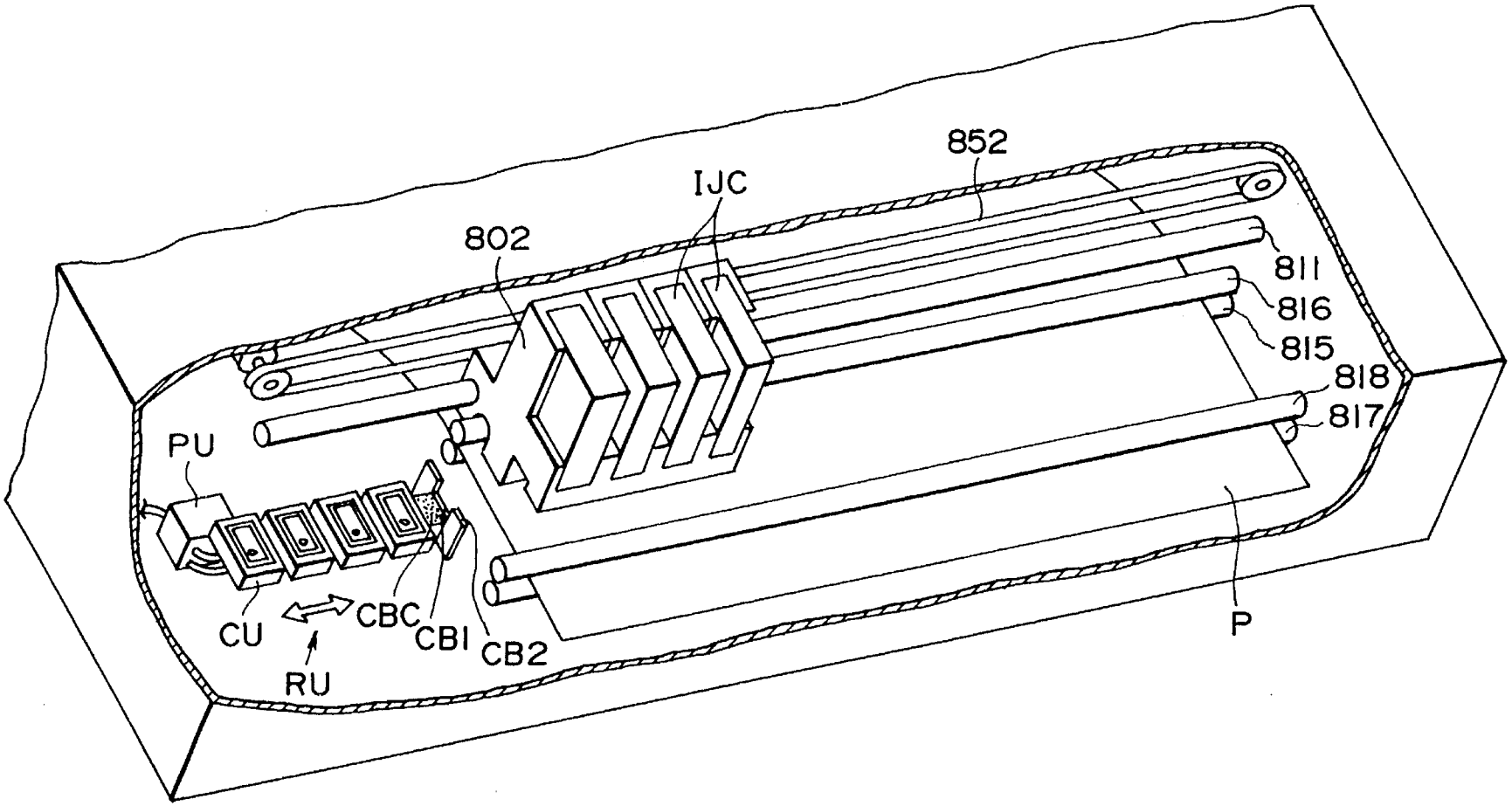
FIG. 26 is a perspective view illustrating an ink jet recording apparatus according to a further embodiment of the present invention.

FIGS. 24 and 25 are a perspective view and a top plan view showing the structure around the carriage of an ink jet recording apparatus to which the cartridge IJC shown in FIG. 21 is detachably mountable.

As will be understood from this Figure, the carriage 802 carries four cartridges IJC1, IJC2, IJC3 and IJC4 containing different color ink material (for example, yellow ink, magenta ink, cyan ink and black ink) at correct positions.

The connector holder (retaining member) 840 has four pins 810 (pushing pins A–D) which are urged leftwardly in FIG. 24 by springs 810*a* (springs A–D). The connector holder 840 is engaged with links 821 (link I and link II) by shafts 820 (shaft I and shaft II), and is movable toward left and right in FIG. 24 by a rotational motion (clockwise or counterclockwise direction) of the operating lever 807 engaged with the links 821. When it is moved to the right, the pressure is released to permit replacement of the cartridge. When it is moved to the left, it receives the cartridge.

When the cartridge IJC is mounted on the mounting portion 802*f*, the recording head unit 886 of the cartridge IJC is inserted from the upward to the leading recess 802*fl* of the mounting portion 802*f*. At this time, the right angle portion 802*h* of the carriage 802 is engaged between the guides 883*b* of the cartridge IJC, so that the cartridge is roughly positioned. When the operating lever 807 is rotated in the clockwise direction about the shaft 809, the holder 840 advances so that the guide 854 of the carriage 802 is inserted into the cut-away portion 883*a* of the cartridge IJC, and simultaneously, the pin 810 is engaged with the cartridge IJC, by which the cartridge IJC is mounted in the mounting portion 802*f*. A spring 859 is mounted on the carriage 802 to produce an urging force to press the cartridge IJC in the mounting portion 802*f* toward the rear to improve the positioning accuracy. The end 810*b* of the pushing pin 810 contacts to the abutment surface 801*d* of the cartridge IJC to urge the cartridge. The outer surface 810*c* of the pushing pin 810 is contacted to the abutment surface 802*s* of the carriage 802 to independently receive the thrust force in the direction perpendicular to the longitudinal direction of the pushing pin. Therefore, the retaining member 840 receives only the reaction force from the spring 810*a* (spring A–D), only. Therefore, the thrust force is not produced. Therefore, when the plural cartridges are simultaneously released, the releasing lever 807 is operated with a small force to permit mounting or dismounting operation.

The description will be made as to the mechanism and operation for the engagement and disengagement between the head connector 885 of the cartridge IJC and the connector (main assembly connector) 806 of the main assembly.

When the main assembly connector 806 is inserted into the head connector 885, the lever 807 is operated while an engaging shaft 806*a* integral with the main assembly connector 806 is engaged in the engaging portion 840*b* of the engaging hole of the connector holder 840 by the resilient force provided by the tension spring 841 or the like, the main assembly connector 806 and the connector holder 840 are moved as a unit. The head connector 885 roughly positioned by the mounting of the cartridge IJC to the mounting portion 802*f* of the carriage 802, and the main assembly connector 806 roughly positioned by the engagement of the engaging shaft 806*a* with the engaging portion 840*b*, are met with each other, and are guided along the slanted surface (not shown) of the main assembly connector 806 until the main assembly connector 806 is engaged (connected) with the head connector 885. Thereafter, the connector holder 840 is moved toward the right through a predetermined distance l toward the rear in FIG. 24 (this movement is provided by rotation of the lever 807). Here, the predetermined distance is sufficient to disengage the engaging shaft 806*a* from the engaging portion 840*b*, and therefore, it is a distance for changing the main assembly connector 806 from the positioned state to the movable (released) state.

Since the main assembly connector 806 is engaged with the head connector 885 with the force stronger than the force by the tension spring, and therefore, the main assembly connector 806 is released from the connector holder 840, that is, they are disengaged. Here, a large diameter portion of the engaging hole 840*a* is larger in diameter than the engaging shaft 806*a* of the main assembly connector 806, and therefore, a gap is produced therebetween. When the main assembly connector 806 is engaged with the head connector 885, the main assembly connector 806 is separated from the connector holder 840, and therefore, the cartridge IJC is positioned relative to the carriage 802 only by the urging force of the urging pin 810, so that the correct positioning of the recording head 886 relative to the carriage 802 is assured.

Next, when the cartridge IJC is dismounted (released), the lever 807 is rotated in the counterclockwise direction from the upright position to the horizontal position (FIG. 24 position). The engaging shaft 806*a* is connected with the head connector 885 with a strong force, but with the rightward movement of the connector holder 840, the large diameter side surface of the engaging hole 840*a* abuts the engaging shaft 806*a* to push it toward the rear in FIG. 24 to release the main assembly connector 806 from the head connector 808. Simultaneously, the pushing pin 810 moves as a unit with the connector holder 840, and is moved away from the recording head 886.

In FIG. 24 or 25, a scanning rail 811 extends in the main scan direction of the carriage 802 to support the carriage 802 for sliding movement thereon. Designated by a reference

811*a* is a bearing. A flexible cable 850 for information transfer with the cartridge IJC through connectors. A belt 852 functions to transmit the driving force for reciprocating the carriage 802. Pairs of rollers 817, 818 and 815 and 816 are disposed at the front and rear of the recording position by the head unit 886 to feed the recording medium. A platen 850 functions to provide a flat recording medium surface.

Referring to FIG. 24, the description will be made as to the ink jet recording apparatus using the above structure. In the apparatus a recovery system unit RU is disposed at a home position side at the left of FIG. 24.

In the recovery system unit RU, a capping unit CU is provided for each of the plural cartridges IJC having the recording head units 886. It is slidable to the left and right together with the movement of the carriage 802, and is also movable in the vertical direction. When the carriage 802 is at the home position, it is engaged with the head unit 886 to cap it.

The recovery system unit RU has a first wiping member (cleaning blade) CB1 and a second wiping member (cleaning blade) CB2, and a blade cleaning CBC of an ink absorbing material for cleaning the first blade CB1. In this embodiment, the first blade CB1 is supported on a proper blade moving mechanism for the vertical movement thereof driven by movement of the carriage 802, so that the first blade CB1 is movable between a projected (raised) position wherein it wipes the neighborhood of the ejection outlets of the ejection side surface of the head unit 886 and a retracted (lower) position not interfering with the projected position.

The second blade CB2 is fixed at a position for wiping the portion of the ejection side surface of the head unit 886 which is not wiped by the first blade CB1.

The recovery system unit RU further comprises a pump unit PU communicating with the cap unit CU. It is used to produce vacuum in the sucking operation in which the capping unit CU is engaged to the recording head chip 886. The size of the pump unit PU can be reduced because of the size of the cartridge.

Figure 27:
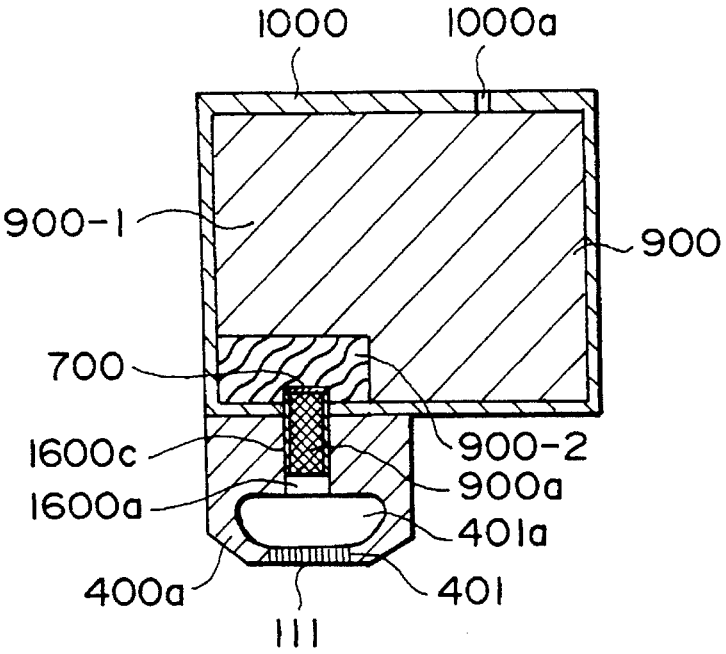
FIGS. 27 and 28 are sectional views of a recording head according to a further embodiment of the present invention.

FIG. 27 shows a further embodiment.

The absorbing material 900*a* in the ink supply passage 1600*a* is compressed beforehand, and the rate of the compression is controllable. Then, it is easily inserted into the ink supply passage 1600*a*. The ink absorbing power is also controllable. To an end of the cylindrical portion 1600*c*, a filter 700 is provided in contact with the absorbing material 900*a*. The absorbing material 900*a* may be inserted into the ink supply passage 1600*a* after the filter 700 is fixed to an end of the absorbing material 900*a* (the above-described structure is applicable to the foregoing embodiments).

In this embodiment, the ink absorbing material 900 in the ink container 1000 is made of two different materials 900-1 and 900-2 having different absorbing power. The absorbing material 900-2 has the stronger absorbing power than the absorbing material 900-1. By the pumping action due to the difference in the absorbing power, the absorbing material 900-2 becomes ink-rich. By giving the stronger absorbing power to the absorbing material 900*a* than the absorbing material 900-2, even if the difference is slight, the ink rich state is assured.

With the above-described structure, it becomes possible that the ink in the ink container 1000 is used up, and the running cost of the cartridge can be reduced. Even if the ink vacancy state occurs, the recovery operation is possible with a small capacity pump as in the foregoing embodiment.

The absorbing material 900*a* is preferably such that it does not produce matters therefrom, or is cleaned by pure water to a sufficient extent.

Figure 28:
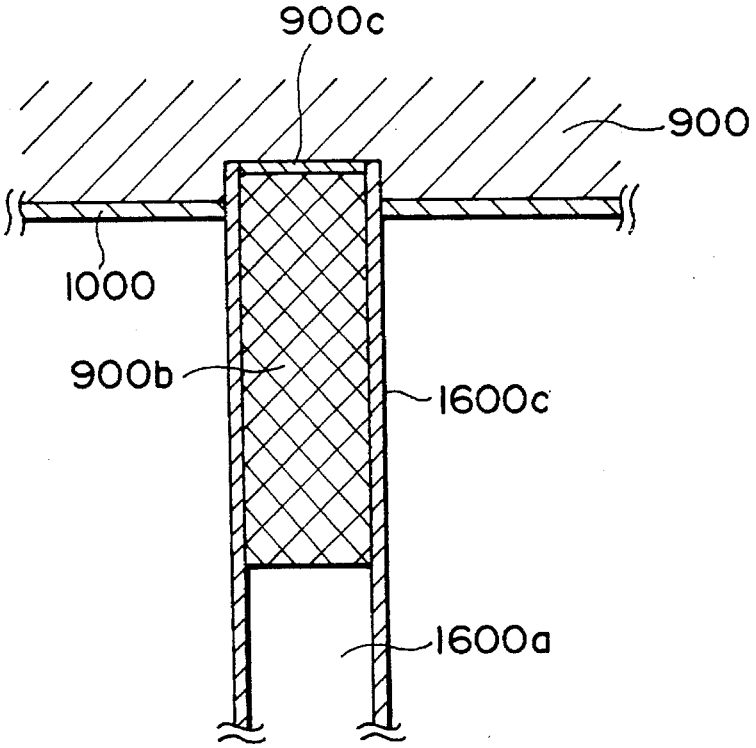

FIG. 28 shows a further embodiment, wherein no separate filter is used, but the skin layer 900*c* at the surface of the absorbing material 900*b* is used as the filter. If the skin layer is made such that the pore diameters are 3–20 microns, it is effective to prevent foreign matter or bubbles from passing to the common chamber.

The inside pore diameters are 10–50 microns in the absorbing material 900*b*, while the surface skin layer has 3–20 microns pores. With the inside pore diameters, the absorbing power by the negative pressure of the absorbing material 900*b* itself can be enhanced, and then, it is not necessary to compress the absorbing material.

The pore diameters of the absorbing material 900*a* in the preceding embodiments is 50–several hundreds microns. By compression of the absorbing material, the absorbing power can be increased. The material of the absorbing material is preferably continuously porous as in foamed polyurethane or the like. The surface skin layer may be used as a filter. In this embodiment, the pore diameters in the inside continuous pores can be controlled. It is, for example, Lubcell available from Toyo Polymer Kabushiki Kaisha, Japan.

In the foregoing embodiments, the ink container is filled with the ink absorbing material, but it may be provided only adjacent the filter. For example, as in the recording head having an integral ink container disclosed in Japanese Patent Application 18228/1988, the ink container is divided into the ink absorbing material portion, an ink supplying portion for supplying to the ejector the ink in the absorbing material and an accommodator for accommodating the ink to be absorbed by the absorbing material.

As described in the foregoing, there is provided an ink jet recording head having an ink container and a head unit integral therewith, wherein a filter is provided at a position for receiving the ink by the recording head unit to prevent introduction of foreign matter, and an absorbing material is disposed in the ink supply passage at the head unit side in close contact with the filter, by which the pumping action by the difference in the absorbing force of the absorbing materials, the ink in the ink container can be efficiently used, so that the running cost of the ink jet recording apparatus can be reduced. Even when the ink vacancy state occurs, the bubbles are not introduced into the absorbing material because the absorbing material in the ink supply passage at the head unit side is in an ink-rich condition so that the virtual air volume inside the ejection outlets is reduced. Accordingly, even if the sucking pump capacity is relatively small, sufficient sucking force can be used in the recovery operation.

By doing so, it is possible to reduce the size and cost of the ink jet recording apparatus. Since the sucking pump has a small size, the consumption of the ink during the sucking recovery operation under the usual improper state without ink vacancy is reduced, so that the running cost can be further lowered.

The present invention is particularly suitably usable in an ink Jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid.(ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal in the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as a computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. An ink jet apparatus for use with an ink jet cartridge detachably mounted thereto, said ink jet cartridge including a head having at least one outlet for ejecting ink, said apparatus comprising:

said ink jet cartridge, said ink jet cartridge further including;

an ink container provided with an ink absorbing material for containing the ink, an ink passage connecting said head at least one outlet and said ink container and through which the ink is supplied from said ink container to said at least one outlet of said head, a first filter provided at an ink container end of said ink passage and press-contacted with said ink absorbing material, a second filter provided at a position in said ink passage so that said first filter and said second filter divide an inside of the passage running from said at least one outlet to said end of said ink passage into a plurality of regions; and a pump having a pumping action for removing ink from said ink jet cartridge, wherein each volume of the plurality of regions is not larger than a capacity of the ink removed by a single said pumping action of said pump, and said capacity is not larger than a volume of said inside of said ink passage.

2. An apparatus according to claim 1, wherein said pump provides an ink flow speed at the filter of not more than about 0.2 cc/((sec)(mm$^2$)).

3. An apparatus according to claim 1, wherein said ink absorbing material is disposed in a compressed state within said ink container.

4. An apparatus according to claim 1, further comprising detecting means for detecting a presence of the ink adjacent to said second filter.

5. An apparatus according to claim 4, wherein said detecting means comprises an electrode.

6. An apparatus according to claim 1, wherein said head has an energy generating means for generating energy in order to eject the ink.

7. An apparatus according to claim 6, wherein said energy generating means comprises an electrothermal transducer for generating thermal energy.

* * * * *

UNITED STATES PATENT AND TRADEMARK OFFICE

CERTIFICATE OF CORRECTION

PATENT NO. : 5,565,899

DATED : October 15, 1996

INVENTORS : HITOSHI SUGIMOTO, ET AL.

It is certified that error appears in the above-identified patent and that said Letters Patent is hereby corrected as shown below:

ON TITLE PAGE

[56] Line FPD, "061764" should read --0261764--;
[57] Line 3, "ink supply passage" should read --an ink passage--;
Line 4, "outlets," should read --outlets and--;
Line 8, "larger than" should read --related to--;
Line 9, "supply passage" should read --and to volumes of regions of the ink passage--.

COLUMN 2

Line 1, "contributable" should read --contributing--;
Line 34, "detection" should read --direction--.

COLUMN 5

Line 42, Delete "2400 and".

UNITED STATES PATENT AND TRADEMARK OFFICE

CERTIFICATE OF CORRECTION

PATENT NO. : 5,565,899

DATED : October 15, 1996

INVENTORS : HITOSHI SUGIMOTO, ET AL.

It is certified that error appears in the above-identified patent and that said Letters Patent is hereby corrected as shown below:

COLUMN 6

Line 29, "is" should read --are--;
Line 48, "it is" should read --they are--;
Line 58, "with" should read --and--.

COLUMN 7

Line 33, "IJU, a" should read --IJU, is a --.

COLUMN 8

Line 2, "wholes" should read --holes--.

COLUMN 9

Line 5, "mass-production." should read --mass production.--;
Line 6, "in conventional" should read --in a conventional--;
Line 19, Delete "to";
Line 22, "combined each" should read --combined with each--;
Line 54, "decreases" should read --decrease--.

UNITED STATES PATENT AND TRADEMARK OFFICE

CERTIFICATE OF CORRECTION

PATENT NO. : 5,565,899

DATED : October 15, 1996

INVENTORS : HITOSHI SUGIMOTO, ET AL.

It is certified that error appears in the above-identified patent and that said Letters Patent is hereby corrected as shown below:

COLUMN 13

Line 29, "side" should read --sides--;
Line 54, "cut-away" should read --cut away--.

COLUMN 14

Line 28, "is" should read --which is--.

COLUMN 15

Line 14, "is slightly away" should read --is spaced slightly away--;
Line 16, "bin" should read --pin--;
Line 18, Delete "by";
Line 33, "claps" should read --caps--.

COLUMN 16

Line 4, "again" should read --again moved--;
Line 51, Delete "the";
Line 51, "in ink" should read --in the ink--.

UNITED STATES PATENT AND TRADEMARK OFFICE

CERTIFICATE OF CORRECTION

PATENT NO. : 5,565,899

DATED : October 15, 1996

INVENTORS : HITOSHI SUGIMOTO, ET AL.

It is certified that error appears in the above-identified patent and that said Letters Patent is hereby corrected as shown below:

COLUMN 17

Line 23, "recovery" should read --recover--;
Line 32, "experiments was" should read --experiments were--;
Line 32, "is" should read --was--;
Line 62, "Jet" should read --jet--.

COLUMN 21

Line 15, Delete "and";
Line 16, Delete "therefore,";
Line 35, "is" should read --are--;
Line 49, "recovery" should read --recover--.

COLUMN 22

Line 31, Delete "and";
Line 32, Delete "therefore,";
Line 44, "the bubble" should read --bubbles--.

COLUMN 23

Line 67, Delete "to".

UNITED STATES PATENT AND TRADEMARK OFFICE

CERTIFICATE OF CORRECTION

PATENT NO. : 5,565,899

DATED : October 15, 1996

INVENTORS : HITOSHI SUGIMOTO, ET AL.

It is certified that error appears in the above-identified patent and that said Letters Patent is hereby corrected as shown below:

COLUMN 24

Line 6, "D), only." should read --D).--;
Line 39, "the" (2nd occurrence) should read --a--;
Line 40, Delete "and";
Line 56, Delete "position".

COLUMN 25

Line 2, "transfer" should read --transfer connects--;
Line 53, Delete "the" (1st occurrence);
Line 56, Delete "the".

COLUMN 26

Line 25, "Japanese Patent" should read --Japanese Laid-Open Patent;
Line 26, "Application 18228/1988," should read --Application 198864/1990,--;
Line 56, "Jet" should read --jet--.

UNITED STATES PATENT AND TRADEMARK OFFICE

CERTIFICATE OF CORRECTION

PATENT NO. : 5,565,899

DATED : October 15, 1996

INVENTORS : HITOSHI SUGIMOTO, ET AL.

It is certified that error appears in the above-identified patent and that said Letters Patent is hereby corrected as shown below:

COLUMN 27

Line 2, "liquid.(ink) should read --liquid (ink) --;
Line 10, Delete "the" (1st occurrence);
Line 31, "wave" should read --waves--.

COLUMN 28

Line 4, "the" should read --a--; (2nd occurrence)
Line 13, Delete ",";
Line 45, Delete "head".

Signed and Sealed this

Eighth Day of April, 1997

*Attest:*

*Attesting Officer*

BRUCE LEHMAN

*Commissioner of Patents and Trademarks*